United States Patent [19]

Yang

[11] Patent Number: 4,592,262

[45] Date of Patent: Jun. 3, 1986

[54] REMOTE CONTROL SYSTEM FOR A MUSICAL INSTRUMENT OR INSTRUMENTS

[76] Inventor: Tai-Her Yang, P.O. Box 84-85, Taipei, Taiwan

[21] Appl. No.: 625,796

[22] Filed: Jun. 28, 1984

Related U.S. Application Data

[63] Continuation-in-part of Ser. No. 530,616, Sep. 9, 1983, abandoned, which is a continuation of Ser. No. 344,712, Feb. 1, 1982, abandoned, and a continuation of Ser. No. 561,127, Dec. 13, 1983, abandoned, which is a continuation of Ser. No. 307,520, Sep. 30, 1981, abandoned.

[51] Int. Cl.[4] ..... G10F 1/16; G10G 3/04

[52] U.S. Cl. ..... 84/115; 84/19; 84/462; 84/DIG. 27

[58] Field of Search ..... 84/17–23, 84/107, 112, 113, 115, 171, 244–246, 462, DIG. 1, DIG. 27, DIG. 4, DIG. 7, DIG. 10, DIG. 29; 310/12, 15, 17, 23

[56] References Cited

U.S. PATENT DOCUMENTS

| | | | |
|---|---|---|---|
| 1,123,356 | 8/1915 | Reed | 84/21 |
| 1,152,841 | 9/1915 | Reed | 84/21 |
| 1,924,713 | 8/1933 | Eremeef | 84/171 X |
| 3,604,299 | 9/1971 | Englund | 84/115 |
| 3,709,085 | 1/1973 | Del Castillo | 84/166 |
| 3,757,024 | 9/1973 | Stinson, Jr. et al. | 84/1.17 |
| 3,757,046 | 9/1973 | Williams | 84/DIG. 1 X |
| 3,818,115 | 6/1974 | Hirano | 84/DIG. 1 X |
| 3,871,247 | 3/1975 | Bonham | 84/1.16 |
| 3,905,267 | 9/1975 | Vincent | 84/115 |
| 4,023,456 | 5/1977 | Groeschel | 84/115 |
| 4,099,437 | 7/1978 | Stavrou et al. | 84/1.01 |
| 4,172,403 | 10/1979 | Campbell et al. | 84/1.28 |
| 4,198,890 | 4/1980 | Massey et al. | 84/1.01 |
| 4,247,793 | 1/1981 | Rough | 310/12 |
| 4,338,846 | 7/1982 | Pogoda | 84/1.16 X |
| 4,338,847 | 7/1982 | Brennan | 84/20 |
| 4,341,143 | 7/1982 | Minerd | 84/115 |
| 4,351,221 | 9/1982 | Starnes | 84/21 X |
| 4,450,749 | 5/1984 | Staanke | 84/462 |

*Primary Examiner*—William B. Perkey

*Attorney, Agent, or Firm*—Cushman, Darby & Cushman

[57] ABSTRACT

This invention relates to a remote control system for a musical instrument or instruments. In particular the control system comprises at least one keyboard having a plurality of keys each coupled to means for sensing key operation and key velocity or force, a signal generator for producing a string percussing signal, transmission means for transmitting the signal to at least one remote instrument having a string percussing arrangement coupled to a receiver circuit in the instrument for receiving the string percussing signal, the arrangement being operable in response to the signal to produce an audible sound corresponding to the operation of the keyboard.

16 Claims, 52 Drawing Figures

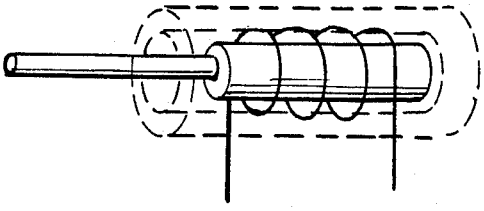
FIG. 3A
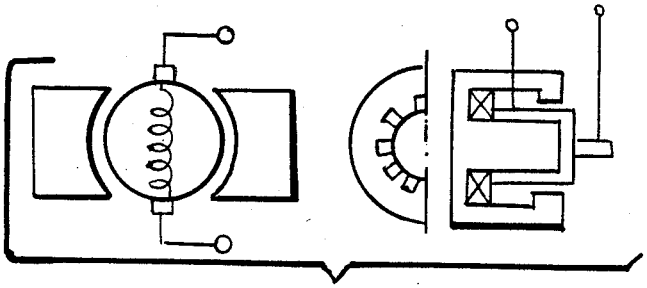
FIG. 3B
FIG. 3C
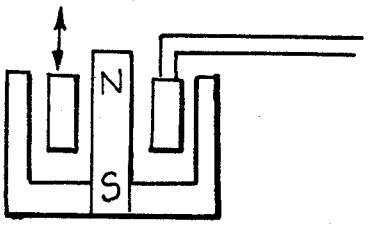
FIG 3D
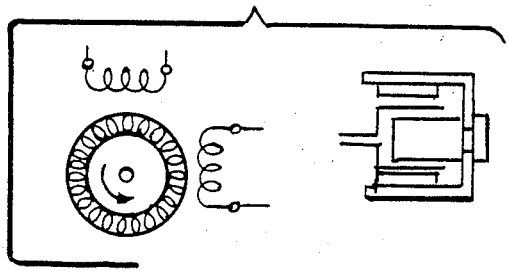
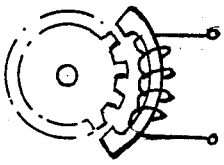
FIG. 3E
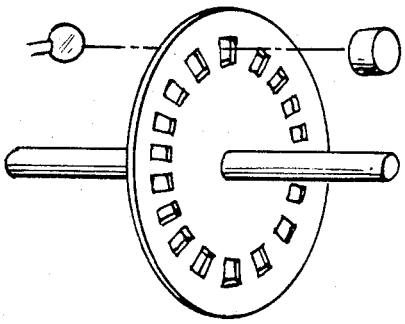
FIG. 3F
FIG. 3G
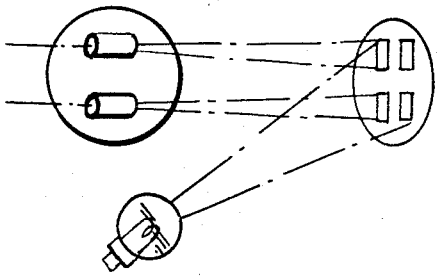
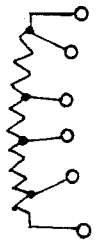
FIG. 3H

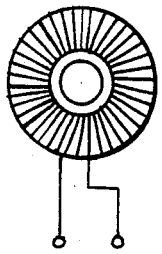
FIG. 3I(a)
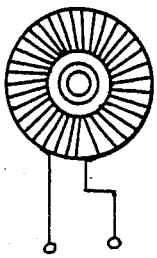
FIG. 3I(b)
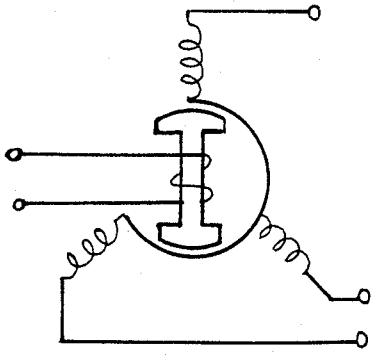
FIG. 3J
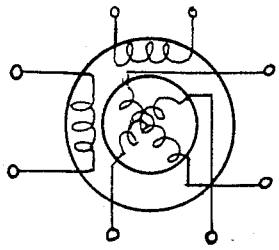
FIG. 3K
FIG. 3L
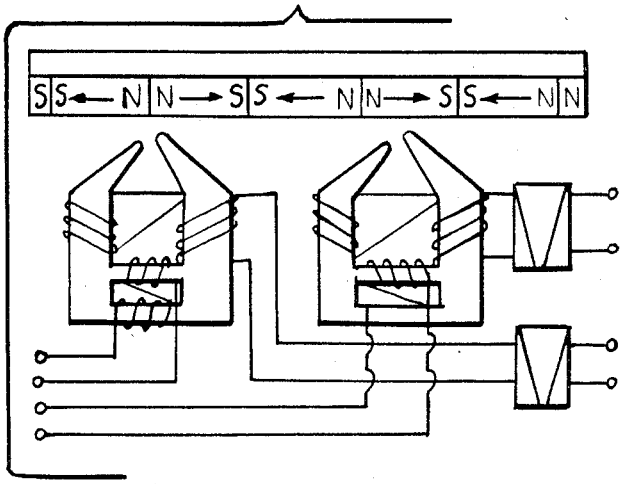
FIG. 3M
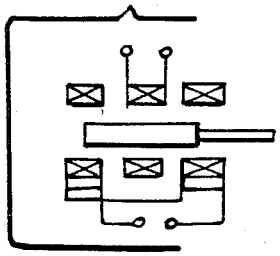
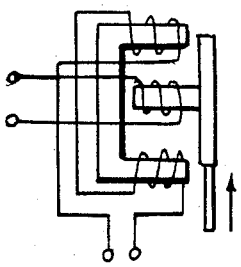
FIG. 3N
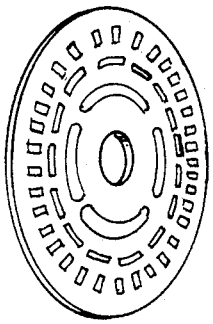
FIG. 3O
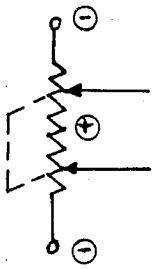
FIG. 3P FIG. 4A
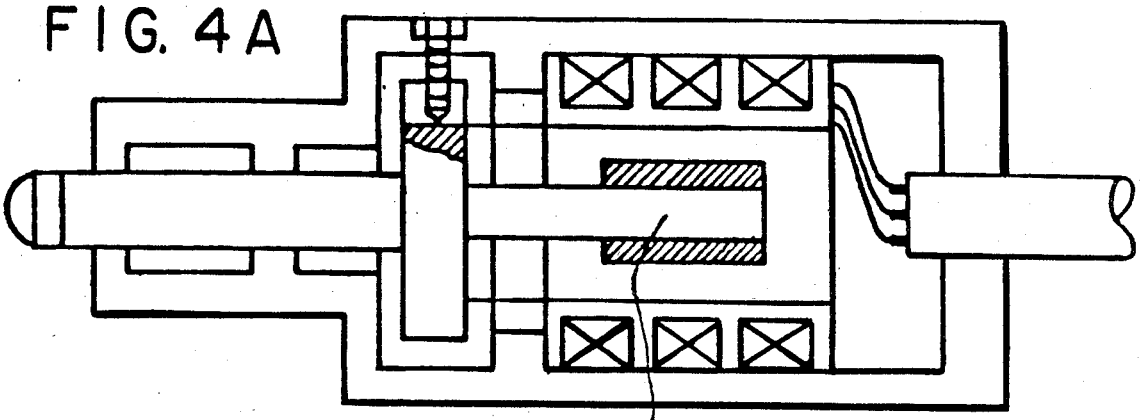
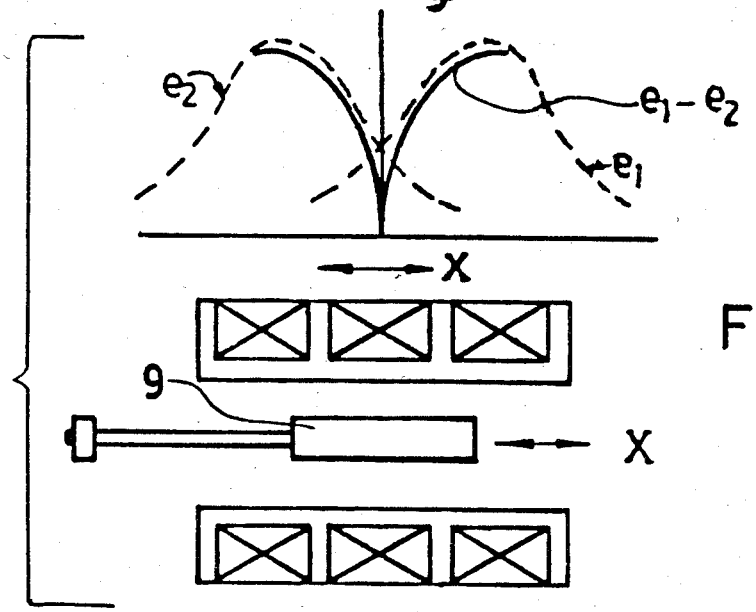
FIG. 4B
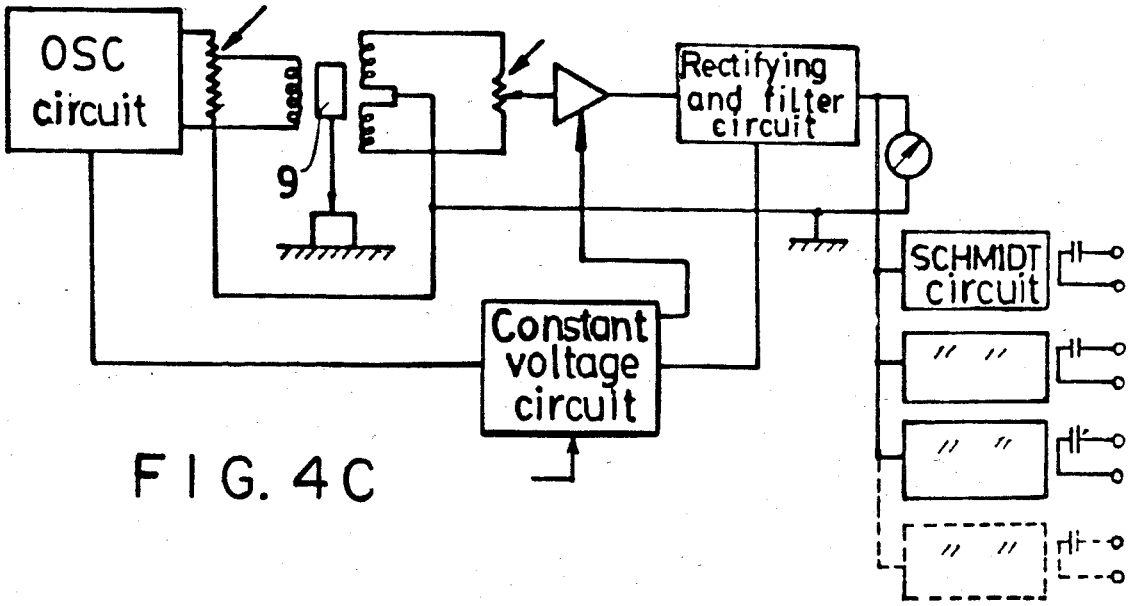
FIG. 4C FIG. 5A
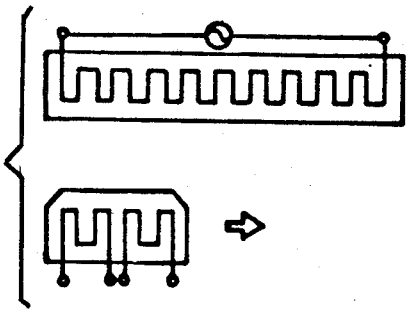
FIG. 6B
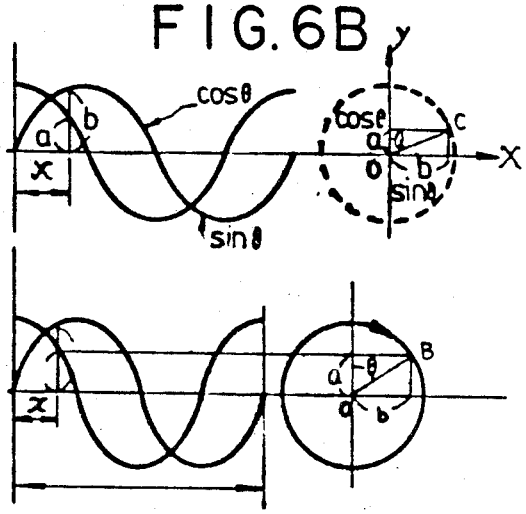
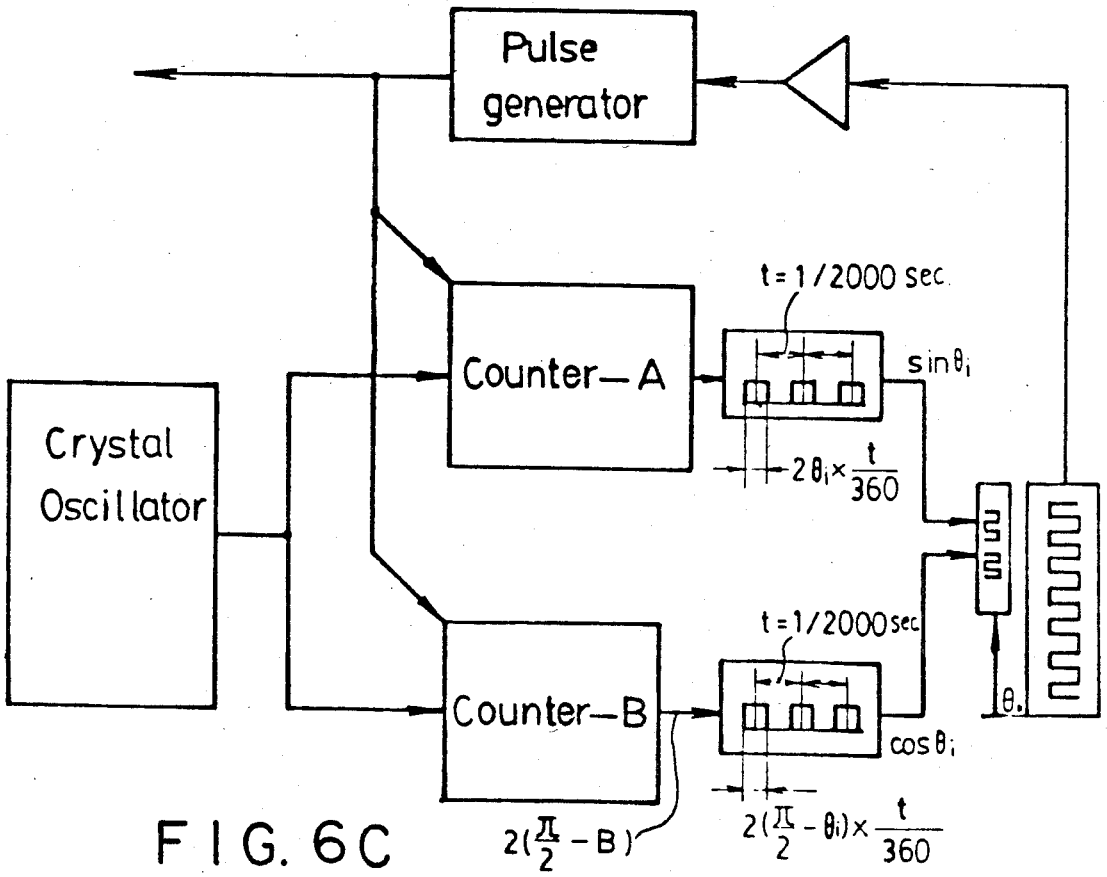
FIG. 6C FIG. 9E
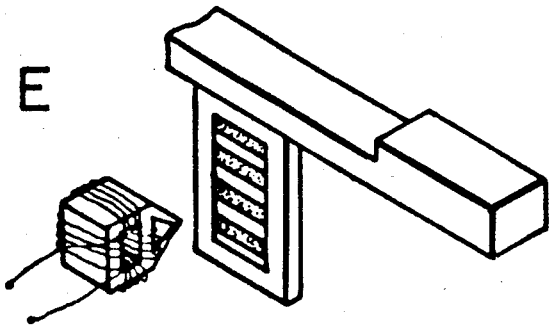
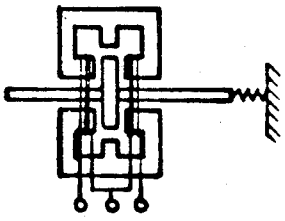
FIG. 10A
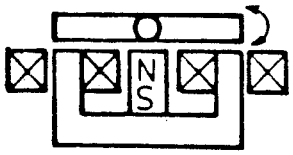
FIG. 10B
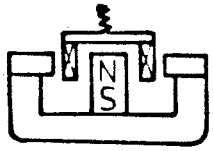
FIG. 10C
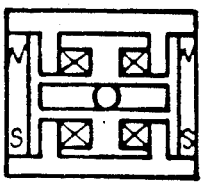
FIG. 10D
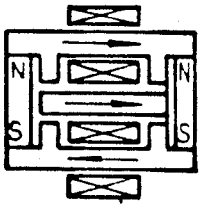
FIG. 10E
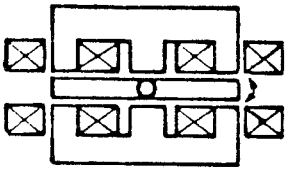
FIG. 10F
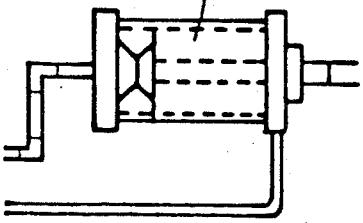
FIG. 10I
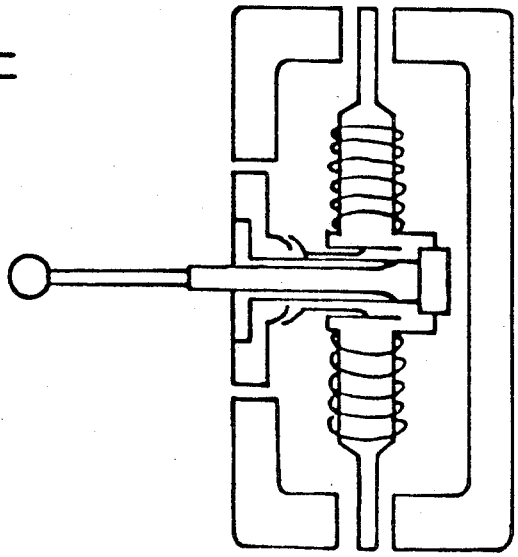
FIG. 10G FIG. 15A
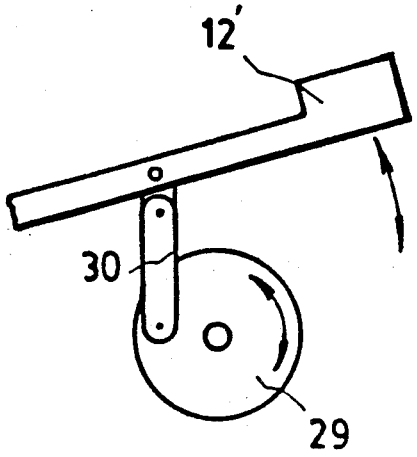
FIG. 15B
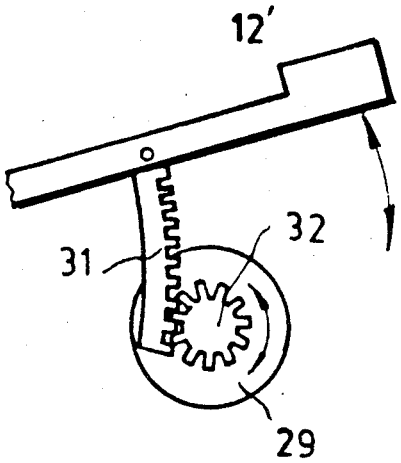
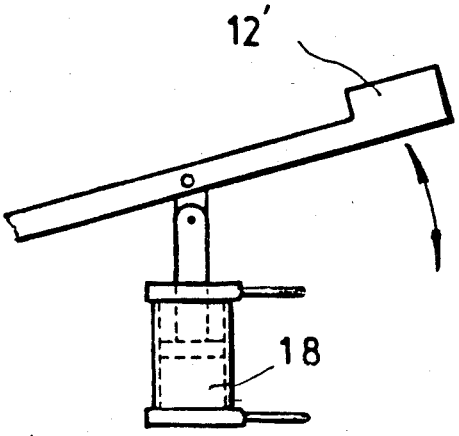
FIG. 15C
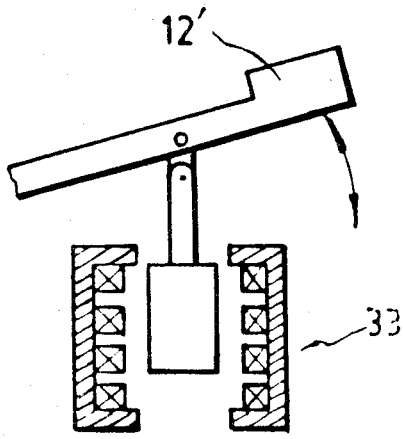
FIG. 15D

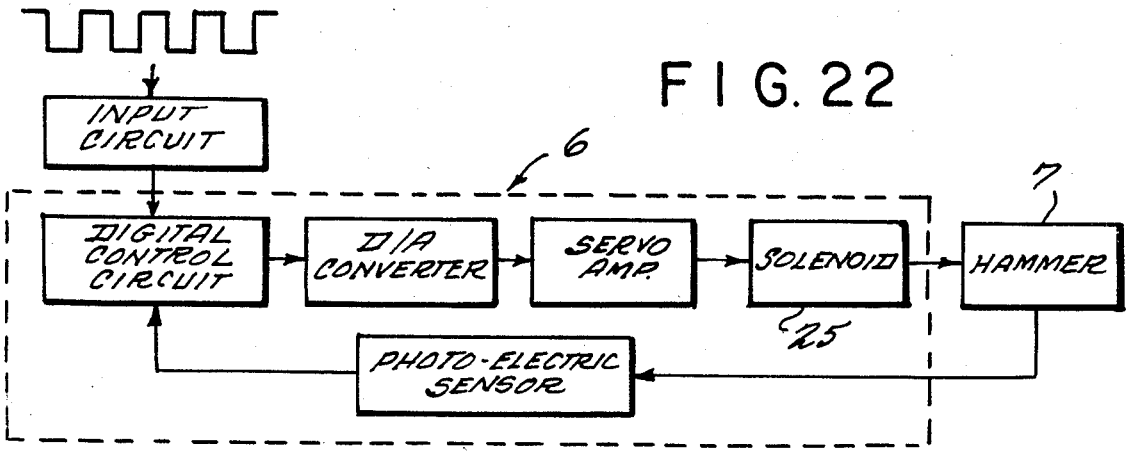
FIG. 22
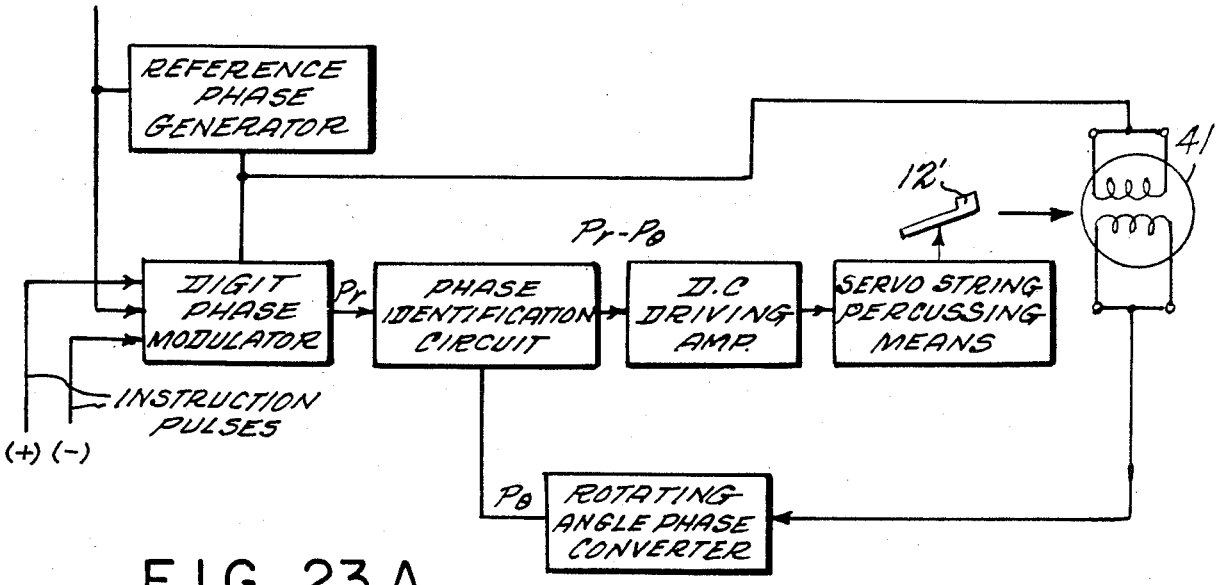
FIG. 23A
FIG. 23B
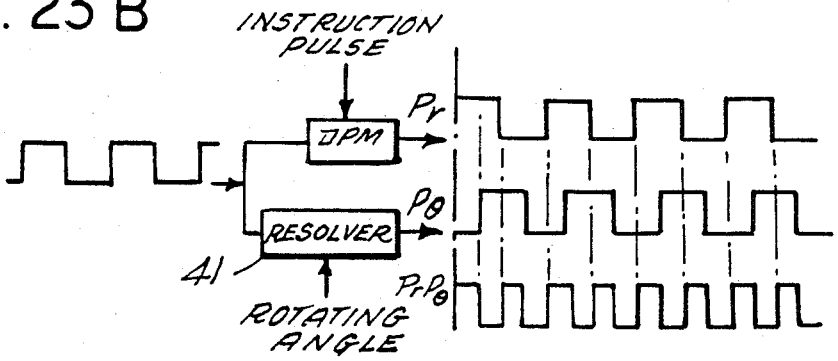

FIG. 24A
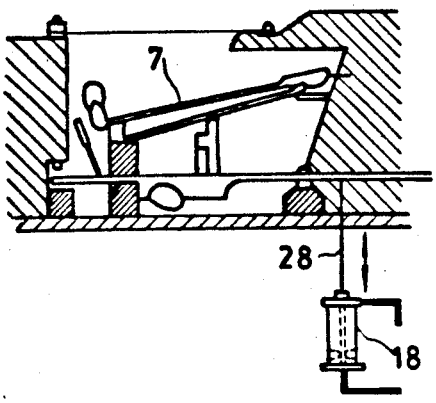
FIG. 24 B
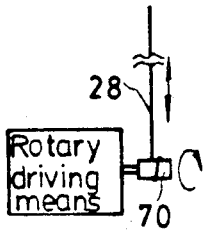
FIG. 25A
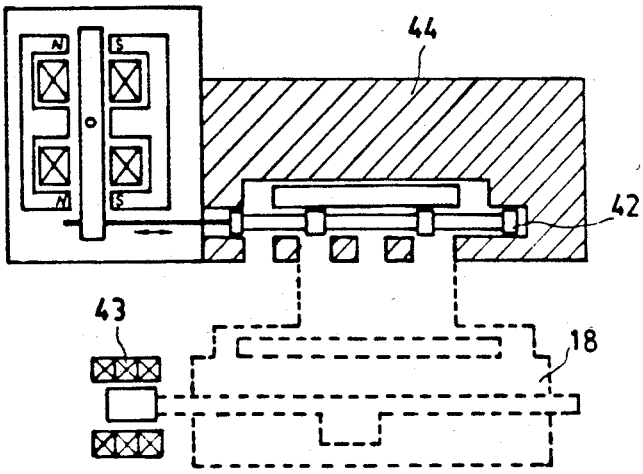
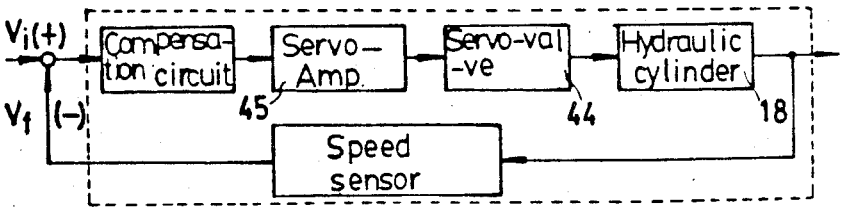
FIG. 25B FIG. 26A
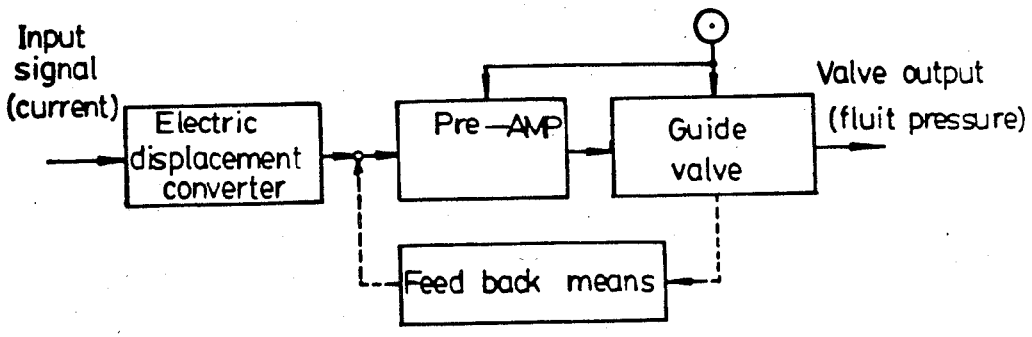
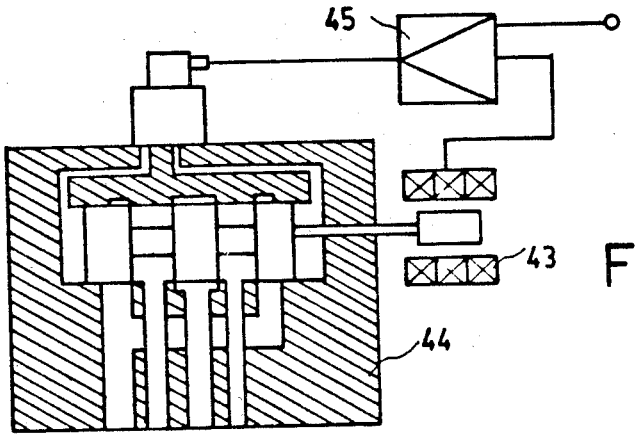
FIG. 26B
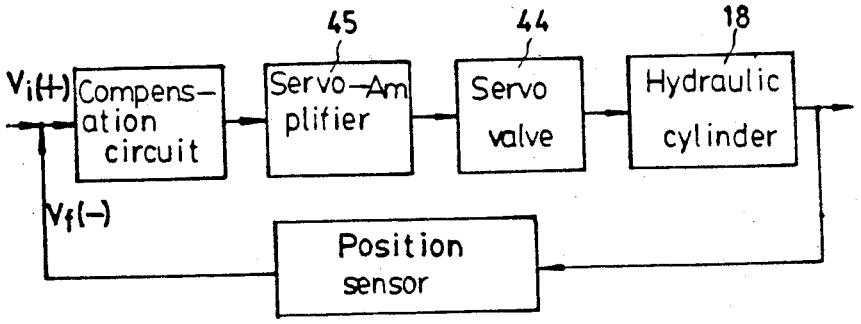
FIG. 27

FIG. 49
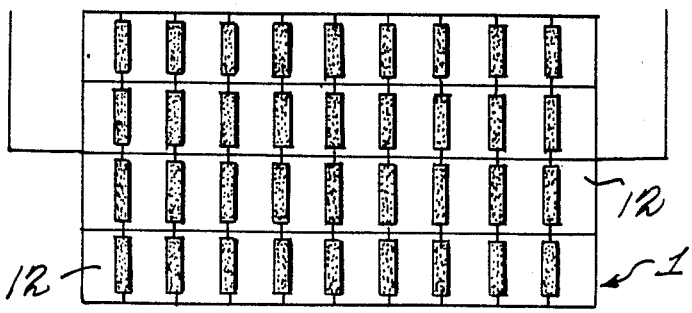
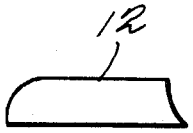
FIG. 50
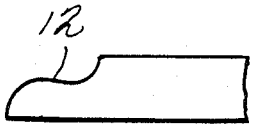
FIG. 51
FIG. 52
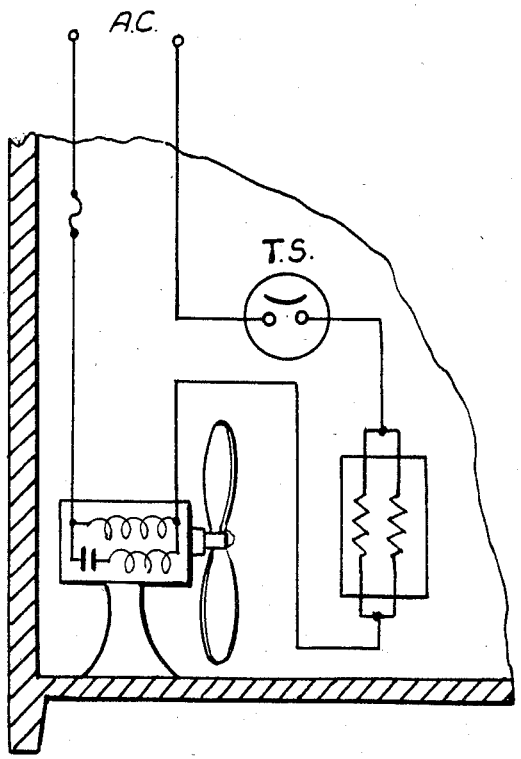

REMOTE CONTROL SYSTEM FOR A MUSICAL INSTRUMENT OR INSTRUMENTS

CROSS-REFERENCE TO RELATED APPLICATIONS

This application is a continuation-in-part of my copending application Ser. No. 530,616 filed on Sept. 9, 1983, now abandoned, (which itself is a continuation of my application Ser. No. 344,712 filed on Feb. 1, 1982, now abandoned) and my copending application Ser. No. 561,127 filed Dec. 13, 1983, now abandoned, (itself a continuation of my application Ser. No. 307,520 filed on Sept. 30, 1981, now abandoned). The entire disclosure of my application Ser. Nos. 530,616 and 561,127 are hereby incorporated by reference into this application.

This invention relates to a remote control system for a musical instrument or instruments. In particular the invention relates to a remote control and transmission system for piano rendition of which the major feature is that, in order to meet player's requirement, the keyboard or the shape of the discrete keyboard and the shape of each key have been re-designed; further, a string-percussion signal generator for sensing the key operation is installed underneath each key. Said signal generator will be driven upon the key being played; simultaneously, a signal sensed (an analog signal or a series of digital signal) corresponding to the player's fingering skill and fingering force will be generated and used as a string-percussion servosignal. Subsequently, said string-percussion signal will pass through a signal transmission and processing circuit so as to have said signal modulated, with RF, into FM, AM, or PCM for further transmission, or to have said signal transmitted directly by means of a guided light means, a wire, or fluid pipe system in an analog or digital metho, or scanning method. The said signal may also be transmitted to one or more than one terminal piano at a remote place, where said signal will be received by a string-percussion and driving circuit in the terminal piano so as to generate a corresponding instruction to drive the string-percussion hammer and the key of a terminal piano for obtaining a corresponding operation; the terminal pianos may be connected in parallel to obtain larger volume or to generate a stereo rendition result.

Another feature of the present invention is that, in addition to simultaneously and separately playing two or more than two pianos (or discrete keyboards) to obtain a varying combined forte, point for generating the aforesaid stereo rendition result, a single piano or a discrete keyboard may be furnished with a "forte point control means" beside the keyboard so as to manually control the string percussion strength of every terminal piano and to have the displacement of the combined forte point varied in order to obtain the stereo result.

A further feature of the present invention is that the sensed key operation signal which is generated by the primary rendition piano or the discrete keyboard, or the string-percussion hammer driving signal generated by the terminal piano may first be stored in a computer registering device for layer transmitting to other similar terminal piano for regeneration rendition, i.e. said terminal piano becoming a data-controlled-and-driving piano.

Another further feature of the present invention is that said terminal piano may be furnished with a servo-control function so as to increase the fidelity of the piano tone, and to have the terminal piano become a terminal servo-piano.

A still further feature of the present invention is that, beside the primary rendition piano, a monitor means may be installed to indicate the key speed and the force applied to the key so as to provide a reference to the piano beginner or a regular player.

A still another feature of the present invention is that both the primary rendition piano and the terminal piano may be installed with an automatic string tuning means for the tone scale of each string; instead, a resonant leaf spring assembly may be installed in the resonant chamber of piano for measuring the vibrating frequency of every string; then, the sensing signal will drive the string tuning motor to adjust the tension of the string by winding it for tuning purpose.

Again, a still further feature of the present invention is that one or more than one set of constant temperature means and constant humidity means may be installed in the resonant chamber of the primary rendition piano or the terminal piano so as to maintain a constant temperature and humidity in said resonant chamber in order to maintain a stable tonality.

According to the present invention, a remote control system for a musical instrument or instruments comprises at least one keyboard having a plurality of keys each coupled to means for sensing key operation and key velocity or force, a signal generator for producing a string percussing signal, transmission means for transmitting the signal to at least one remote instrument having a string percussing arrangement coupled to a receiving circuit in the instrument for receiving the string percussing signal, the arrangement being operable in response to the signal to product an audible sound corresponding to the operation of the keyboard. Preferably, the string percussing signal is transmitted simultaneously to four or more instruments each having a respective receiver circuit and string percussing arrangement. Conveniently, the remote control system according to the invention includes a balance circuit for varying the relative amplitudes of the signals fed to the respective string percussing arrangements.

According to a feature of the present invention, the or each remote instrument includes servo control means having a feedback circuit for comparing signals corresponding to actual movements of the string percussing arrangement with signals received from the keyboard. Further the sensing means may comprise a plurality of coils and movable core elements, each key being mechanically coupled for the sensing means to produce relative movement between a respective coil and core element.

BRIEF DESCRIPTION OF THE DRAWINGS

FIGS. 3(A)–3(P) shows 16 different conventional analog or digital sensing means to be used for the string-percussing signal generator in the present invention;

FIGS. 4(A)–4(C) shows a differential voltage-varying sensing means, in which (A) is a sectional view thereof, (B) is a characteristic curve thereof, and (C) is the circuit of the sensing means;

FIGS. 6(A)–6(C), 7(A)–7(C), and 8 show respectively the structure and characteristics of three sensing means as shown in FIGS. 3I, 3E and 3M.

FIGS. 9A to 9E show how the five sensing means to be installed underneath the piano keys for sensing the operation of the keys; in those Figures, (A) is a throw-light sensing means, (B) is a reflecting type of throw-light sensing means, (C) is an electro-induction sensing means, (D) is an inductosyn sensing means, and (E) is a magnetic sensing means.

FIGS. 10(A)–10(H) show eight (8) electro-magnetic means (A–F,H–I) which can convert the analog current signal in put into mechanical displacement output, and shows a cylinder (G) that can convert the input fluid pressure or volume variation into a variable displacement of the output axle,; all of the aforesaid means may be used for driving the device of string-percussing hammer in the terminal piano.

FIGS. 15(A)–15(D) show four embodiments of the way of driving the string-percussing hammer.

FIG. 22 is the servo block diagram of the embodiment shown in FIG. 21.

FIGS. 23(A) and 23(B) illustrate the resolver shown in FIG. 3K, which is used as a sensing means of the displacement of the string-percussing hammer in the terminal piano; the said string-percussing means of terminal piano may also be controlled with a phase servo-control method.

FIGS. 24(A) and 24(B) show a linear type or a rotary type of driving means to be used for indirectly driving the string-percussing hammer of terminal piano.

FIG. 25A shows another embodiment of the servo-string-percussing means, in which a hydraulic cylinder is used for driving the string-percussing hammer, and a differentail transformer sensing means is used to test the displacement of the plunger so as to feed back the displacement tested to the driving input terminal of the cylinder.

FIG. 25B is a speedservo block diagram of said embodiment.

FIG. 26A is the basic block diagram of the servo valve shown in FIG. 25A.

FIG. 26B shows the assembling relationship among the servo valve, the servo amplifier, and the sensing means of plunger displacement.

FIG. 27 is a block diagram of the position servo in servo-string-percussing means shown in FIG. 25A.

FIGS. 46 and 47 are the front view of the key board; FIG. 48 is a partial front view of the key boards.

FIG. 49 is the matrix configuration embodiment of the keyboard in the present invention.

FIGS. 50 and 51 show two different shapes of the keys in the present invention.

FIG. 52 shows a constant temperature means and a constant moisture means to be installed in the resonant chamber.

DETAILED DESCRIPTION

Figure 1:
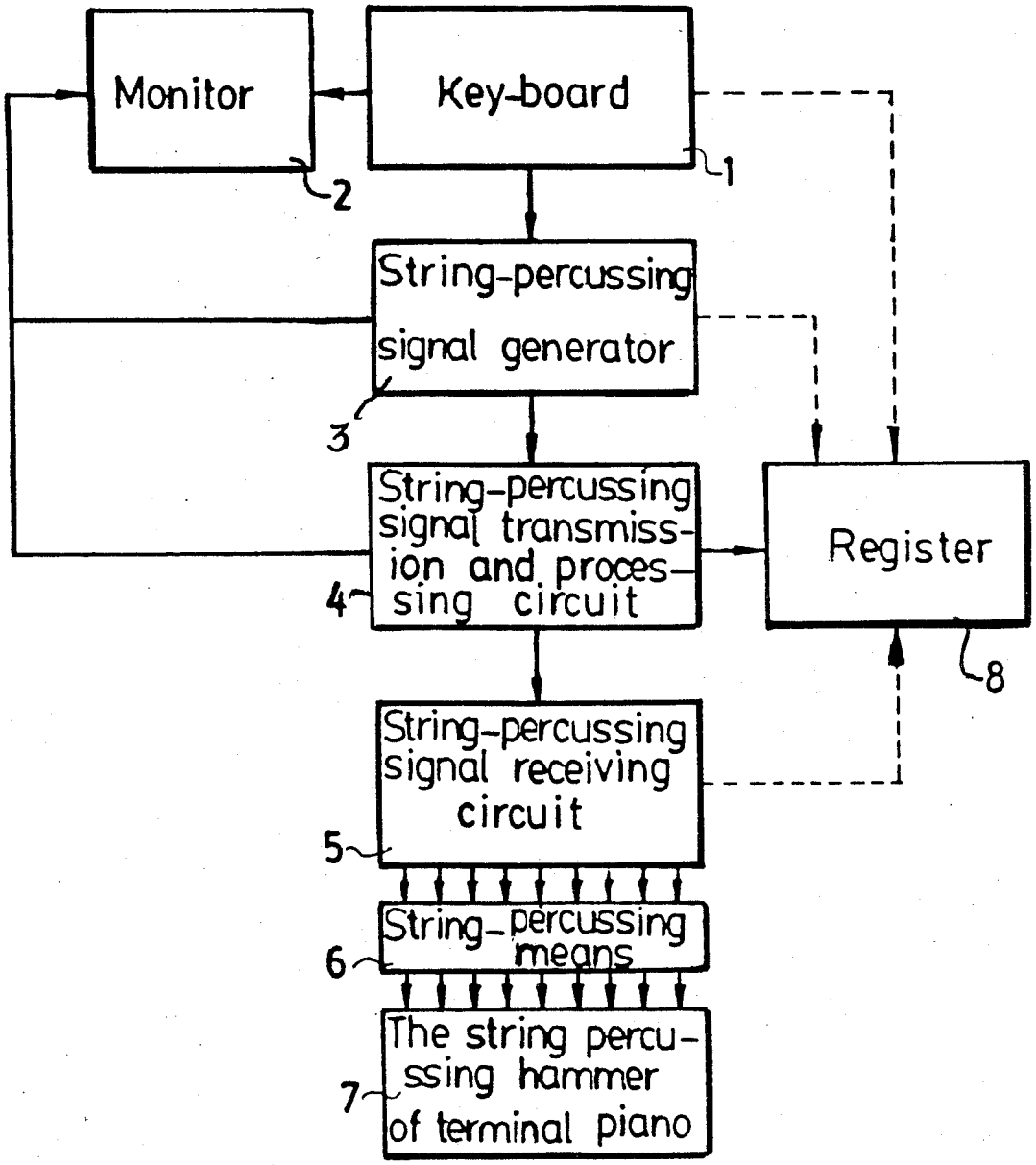
FIG. 1 is the system block diagram of one of the embodiments in the present invention.

The system feature, and the structure of the embodiments in the present invention are described in detail, by referring to the drawings, as follows:

This invention relates to a "Remote Control and Transmission System for Piano Rendition", which comprises:

1. One or more than one set of discrete key-board, or one or more than one primary piano for manual rendition.

2. One or more than one set of string-percussing signal generators for sensing the operation of each key of the said key board, and for delivering a corresponding signal directly or indirectly to drive the string-percussing hammer of terminal piano.

3. A transmission and processing circuit for transmitting and processing the aforesaid string-percussing signal.

4. One or more than one terminal piano which may or may not be provided with a servo-control means.

5. A reception circuit of the string-percussing signal, which will deliver said signal to the string-peruccing means in the terminal piano.

6. A string-percussing means, which may or may not be provided with a servo-control function, and comprises a string-percussing hammer driver so as to actuate the string percussing hammer in the terminal piano.

The aforesaid string-percussing signal transmission and processing circuit, and reception circuit may or may not be used by depending upon the transmission method to be used.

Referring to FIG. 1, there is shown an embodiment, which may include a piano for manual rendition or a set of discrete keyboard, and a terminal piano for remote control rendition. The main feature of said embodiment is that when the keyboard (1) of one piano or a set of discrete keyboard (1) is played manually, a string percussing signal generator (3) installed underneath the key will sense the operation of the keys, and will generate an analog signal corresponding to the fingering skill and force or a series of digital signal; then, said signal will, through the transmission and processing circuit (4) be transmitted to the reception circuit (5) for driving the string-percussing means (6) in the terminal piano to have the string-percussing hammer (7) strike the string so as to obtain a rendition corresponding to primary piano in fingering skill and force, tonality, and melody.

Particularly, since the key operations during rendition including the pressure applied to the keys, the motion speed of the keys will all be sensed by the string-percussing signal generator (3), which will then deliver an analog or digital signal corresponding to said rendition pressure and speed to the transmission and processing circuit (4); after being processed, said signal will be transmitted to a remote place by means of RF in FM, AM or PCM (pulse-code modulation), or will be transmitted directly by means of guide light, wire or the fluid pipe system, or will be amplified first before transmission, or be transmitted by means of scanning method.

Upon the terminal piano receiving the string-percussing signal from a remote station, the said signal will pass a detector and an amplifier (or directly) before driving the string-percussing means (6), in the piano so as to have the non-player terminal pianos in the vicinity of or in the remote place automatically rendered a music same as that of the primary rendition piano. Further, said string-percussing signal may also be transmitted to a recorder (8) for latter transmission to the terminal piano at any time to produce a re-generation rendition.

Figure 2:
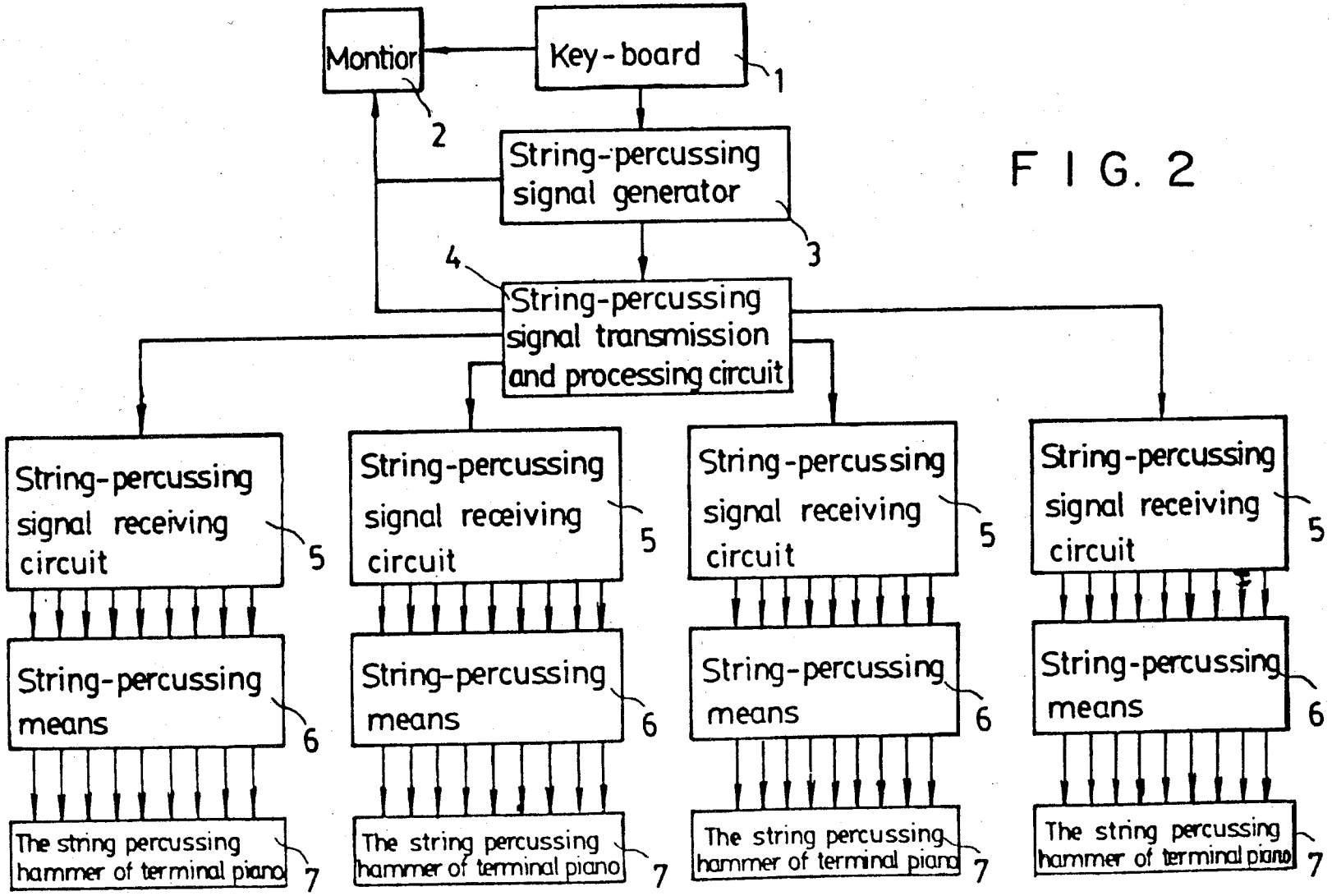
FIG. 2 is the block diagram of the embodiment of a four-terminal-piano system in the present invention.

FIG. 2 is a block diagram showing a system including four terminal pianos.

Referring to FIG. 3 there are shown 16 various conventional analog and digital sensing means to be used in said string-percussing signal generator (3). In FIG. 3(A) is an induction type by using a movable permanent magnet in a coil, (B) is a D.C. generator type, (C) is a motion coil type, (D) is an A.C. generator type, (E) is an electro-magnetic pulse generator type, (F) is a photocell pulse generator type, (G) is a light refection type, (H) is a type of potentiometer with a tap, (I) is a rotary type of induction, (J) is a type of synchronous voltage differential induction, (K) is a resolver type, (L) is a magnetic sensing type, (M) is a differential transmofmer type, (N) is moving iron core type, (O) is a code disk type, and (P) is a differential potentiometer type. In addition, a piezoelectric type of sensing means may also be used in said string-percussing signal generatot (3).

Referring to FIG. 4, there is shown, in detail, the structure and characteristics of a differential transformer type of sensing means as shown in FIG. 3(M). FIG. 4(A) is a sectional view of the structure of the sensing means; FIG. 4(B) shows the relationship between the linear displacement "X" and the differential sensing voltage $e_1$–$c_2$ of the core portion (9); FIG. 4(C) shows the circuit of the sensing means.

Figure 5A:
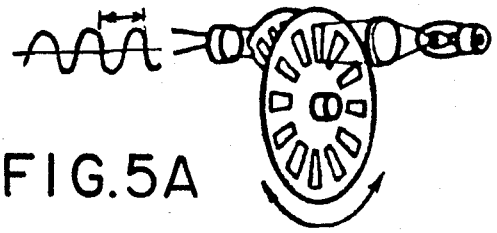
FIGS. 5(A)–5(E) illustrate of the photocell sensing means as shown in FIG. 3F, including the circuit of two photodetectors being used for identifying the moving direction of the piano keys.
Figure 5B:
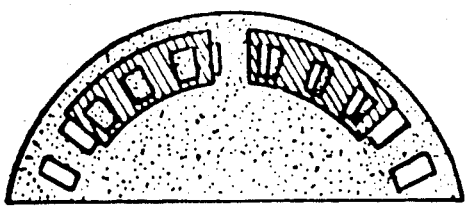
Figure 5D:
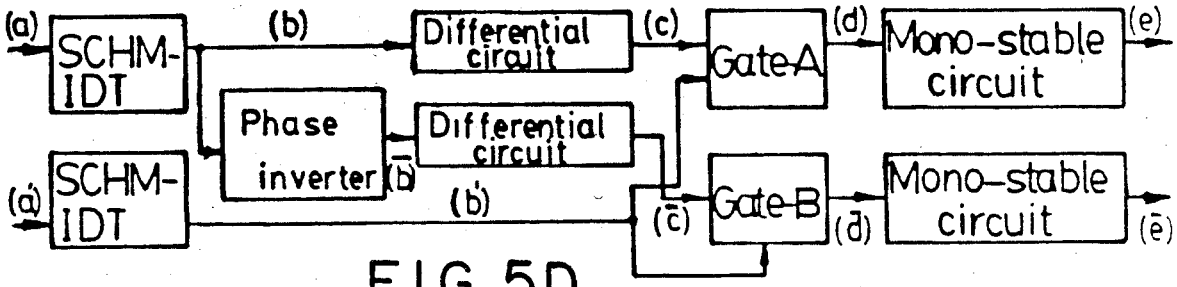
Figure 5C:
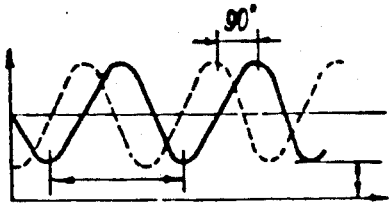
Figure 5E:
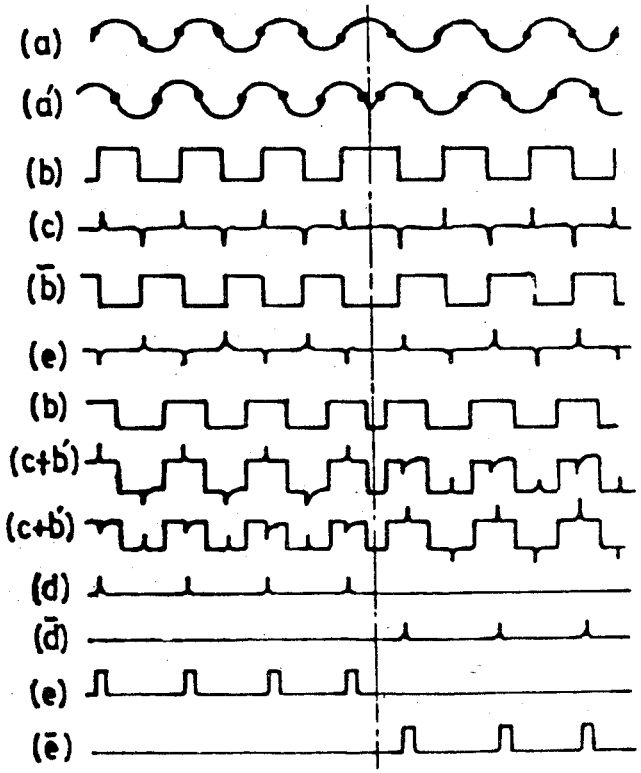

Referring to FIG. 5(A), there is shown the photocell type of sensing means as shown in FIG. 3(F). FIG. 5(B) shows two photo-detectors with an angle difference of 90° between them; the variation of light is sensed with two slit groups (61*a*) and (61*b*) on the round plate (60) shown in FIG. 5(B) so as to measure the motion direction of the piano keys. FIG. 5(C) shows the relationship of the rotation angle between the photo output $v_a$ and $v_b$ of said two photo-detector and the axle (62) (to drive the round plate turning), FIG. 5(D) is a block diagram showing the output of said two sets of photo-detectors being used as an input so as to measure the motion direction of the piano keys. FIG. 5(E) shows the ware-forms appearing on the various points of the circuit shown in FIG. 5(D).

Referring to FIG. 6, there is shown the operation theory and the circuit of the inductosyn sensing means shown in FIG. 3(I).

Figure 7B:
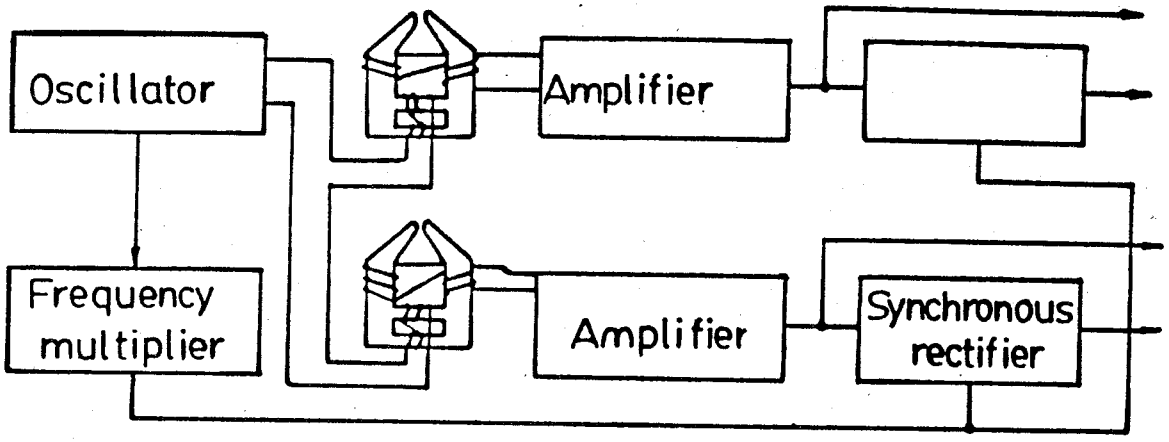
Figure 7C:
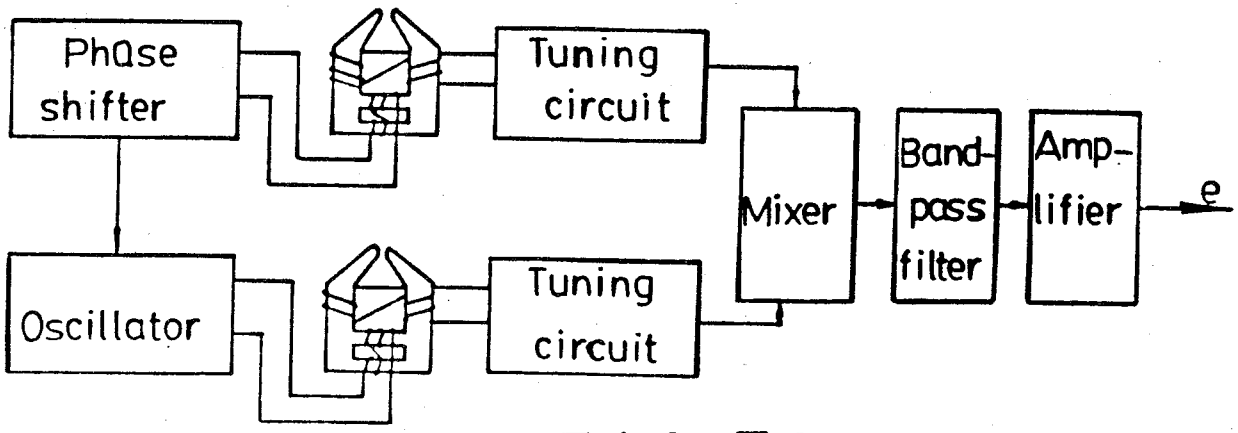
Figure 7A:
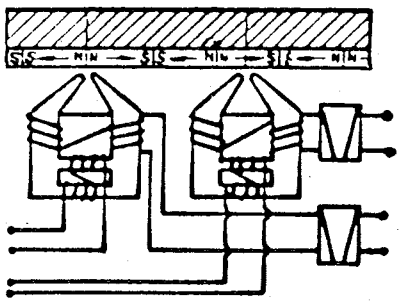
Figure 8:
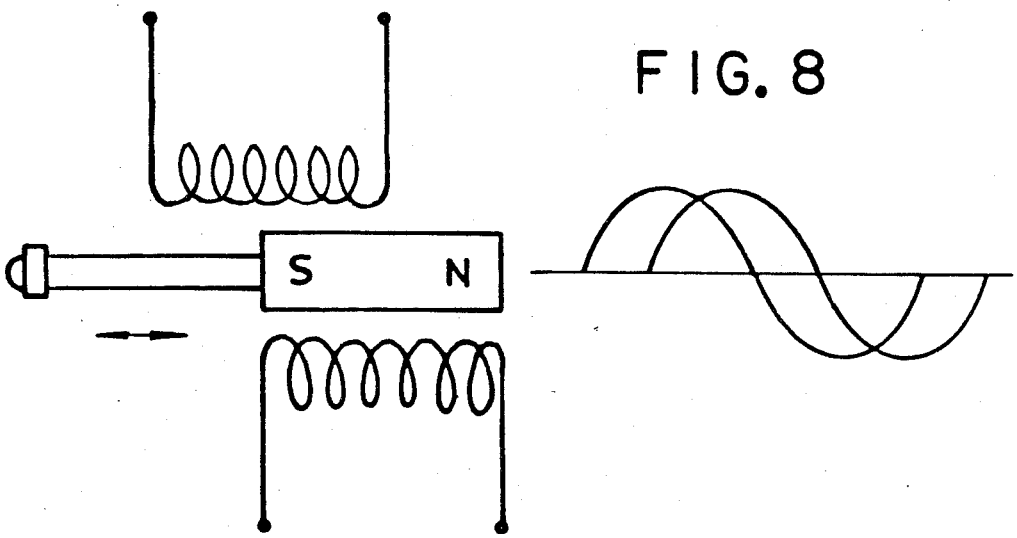

FIG. 7 is the theory and direction-measuring block diagram of the magnetic sensing means shown in FIG. 3(L) FIG. 8 is an embodiment of the two coils and the output voltage waveform of the said differential transformer type of sensing means. Since all the aforesaid sensing means and their operation theory are of conventional, no details thereof will be described.

Referring to FIG. 9, there are shown several embodiments of said various sensing means how to be used as the string-percussing-signal generator (3) in the present invention. FIG. 9(A) shows a grid throw-light means being used as a string-percussing sensing means, which includes a light-throwing element (10), a photo-detector (11), and the light grid (13) installed underneath each key (12) of a primary piano or a discrete key-board. Upon a player pushing the piano keys (12) said sensing means will generate a pulse signal corresponding to the motion speed of the piano keys. FIG. 9(B) shows a light reflection type of sensing means, which includes several reflecting pieces (14), the light-throwing element (10) and the photo-detector (11), which is installed underneath the piano key (12). Upon the piano keys being played, said sensing means will generate a pulse signal corresponding to the motion speed of the piano keys.

Figure 9A:
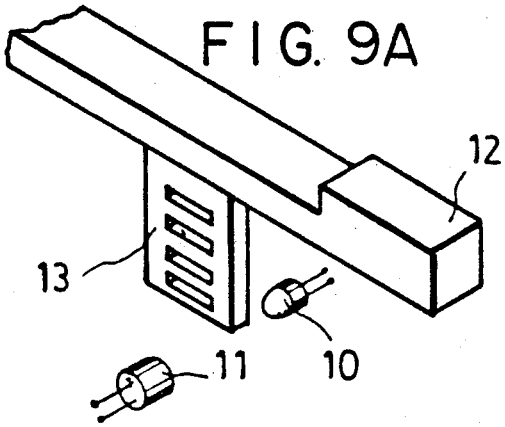
Figure 9B:
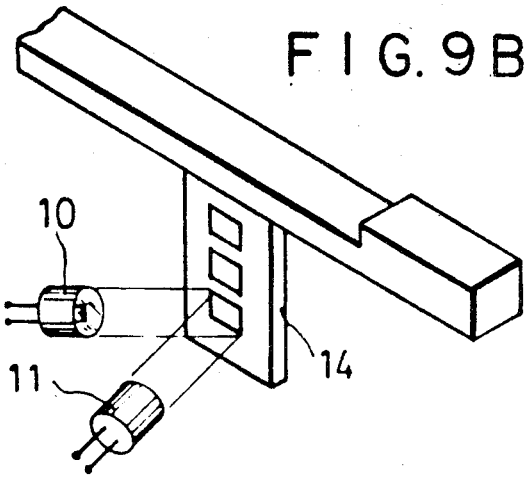
Figure 9C:
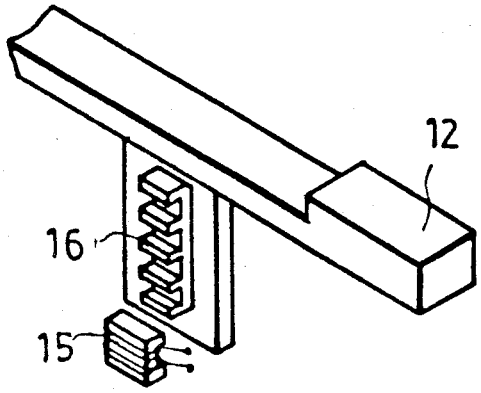

FIG. 9(C) shows an electro-magnetic induction type of sensing means which includes a permanent magnet (15) with a coil and a number of magnetising iron cores (16) arranged abreast. Upon the key being pushed downwards, the magnetising iron core will move down to cause the magnetic reluctance of the field of said permanent magnet to vary and to induce a pulse signal in the coil, of which the strength is varying corresponding to the motion speed of the piano keys.

Figure 9D:
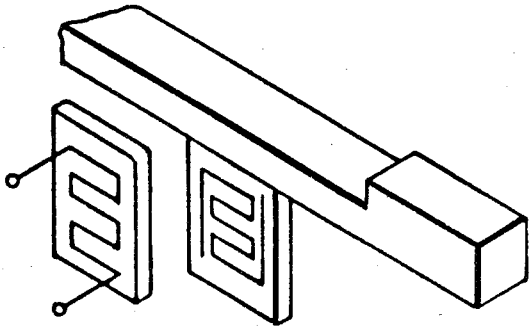

FIG. 9(D) shows an unductosyn (17) sensing means as shown in FIG. 6 to sense the motion speed of the piano keys. FIG. 9(E) shows a magnetic sensing means as shown in FIG. 7 to be used for sensing the motion speed of the piano keys.

Figure 10H:
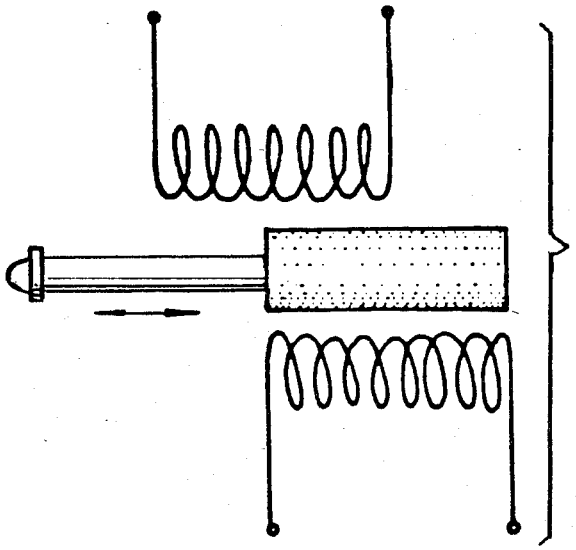

Referring to FIG. 10, there are shown eight (from A to H) conventional electro-magnetic driving means to convert the input analog signal into mechanical displacement. FIG. 10(I) shows a cylinder (18) of which the displacement of the output axle may vary with the input fluid pressure or the fluid quantity. The aforesaid driving means may also be used as the string-percussing hammer driving means of the string-percussing means in the terminal piano of the present invention to drive the string-percussing hammer (7).

Figure 11A:
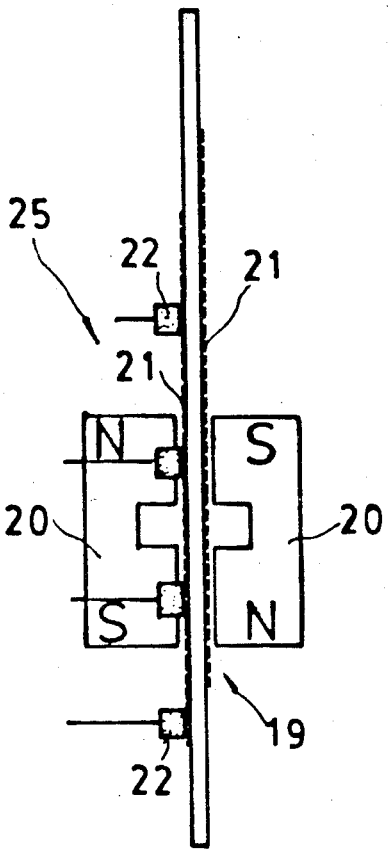
FIG. 11 shows a printing circuit solenoid that may be used as the string-percussing hammer driving means in the servo-string percussing device as shown in FIGS. 1 and 2.
Figure 11B:
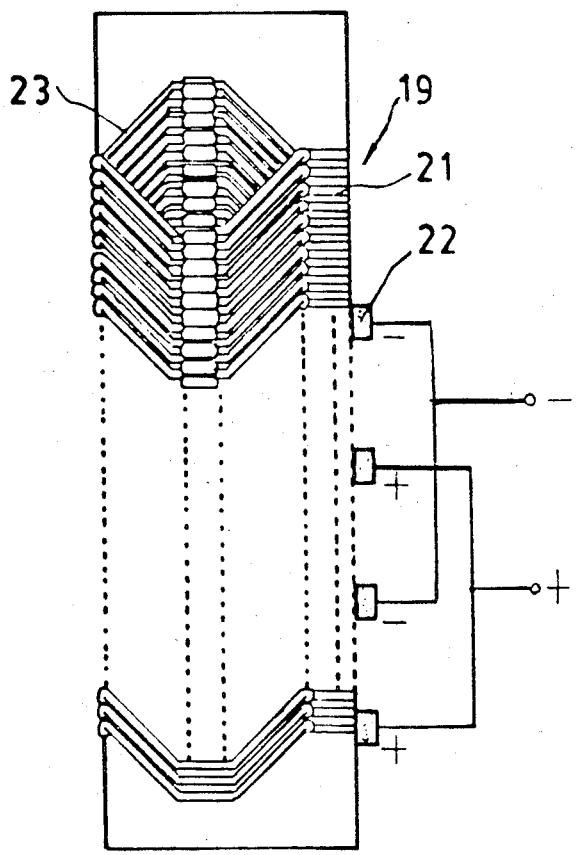

Referring to FIG. 11, there is shown another new innovation, which is a printing circuit solenoid having response to high frequency, and has the feature of including a linear plate with a printing circuit type of windings (19) of whcih two sides are coupled respectively to magnet poles (20) of a permanent magnet. The top end and the lowest end of the winding are not connected each other, but the top of each winding is connected to the parallel commutating step (21) whichmay, if necessary, be installed at one or both edges on one side, or at one or both edges on the both sides of said printing circuit type of winding (19). The brush sets (22) are installed in the opposite side of the parallel commutating strips (21). The windings (23) the permanent magnet (20) and the position of the brushes (22) should be arranged in such a manner as to have the printing circuit type of winding (19) move up and down corresponding to the current direction, and make a displacement in relative speed corresponding to the current waveform variation.

Figure 12:
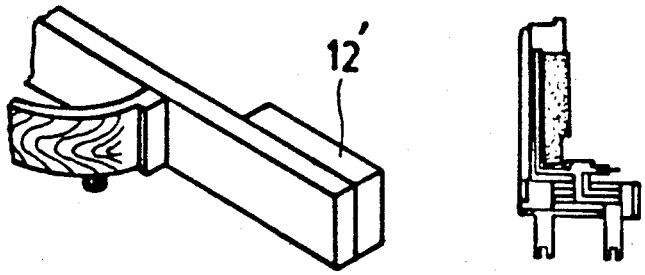
FIG. 12 shows an arc-shaped printing circuit solenoid, which is used to drive the keys of terminal piano in the present invention.

Referring to FIG. 12, there is shown an arc-shaped embodiment of the printing circuit type of solenoid (25) which may be installed in the terminal piano to be used as a string-percussing hammer driving means.

Figure 13:
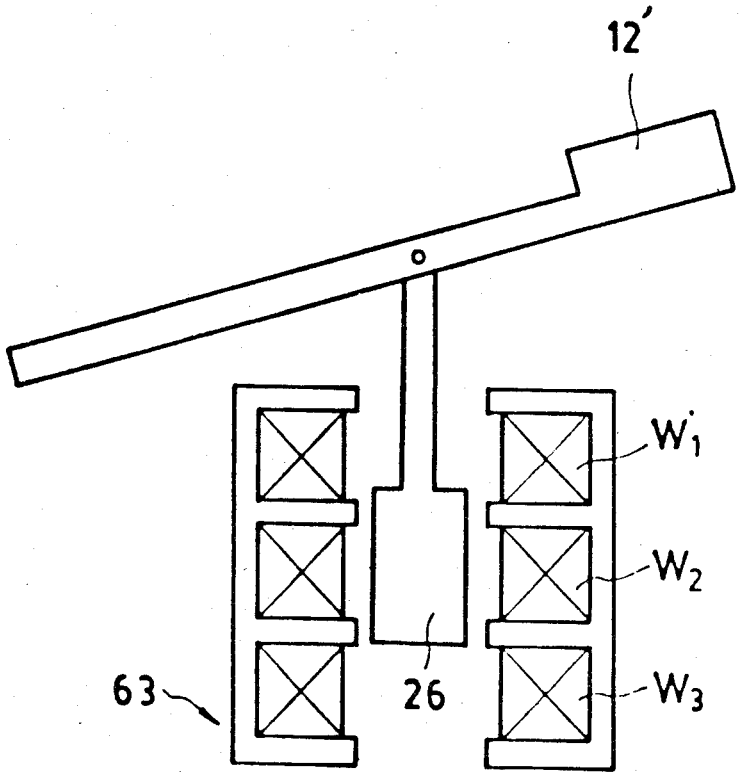
FIG. 13 is a view, in which three windings W1, W2 and W3 are excited in sequence to drive the string-percussing hammer.

By referring to FIG. 10, some of the driving means are exemplified how to be installed in the terminal piano of the present invention to be used as string-percussing driving means (27) to drive the string-percussing-hammer (7) and the piano key (12') and they are described as follows:

Referring to FIG. 13, there is shown a driving means made of a mechanical-to-electric energy transducer (63) in which the three windings W1,W2 and W3 are energised respectively with a driving current in right sequence so as to drive the iron core (26) to move linearly for actuating the piano key (12') of a terminal piano and the string-percussing hammer (not shown) to render a note. That drive means may obtain better fidelity.

Figure 14A:
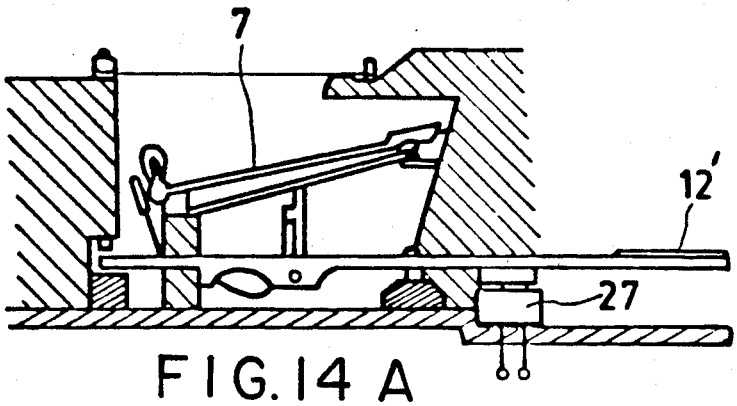
FIGS. 14(A)–14(C) several embodiments of the installing position and the way of driving for the string-percussing hammer driving means; and the way of driving in the Fig., (A) shows the string-percussing hammer driving means being installted underneath the key, (B) shows the string-percussing hammer driving means being installed in the upper portion adjacent to the vulcrum of the string-percussing hammer, (C) shows the string-percussing hammer and the key being driven indirectly by means of a steel cable.
Figure 14B:
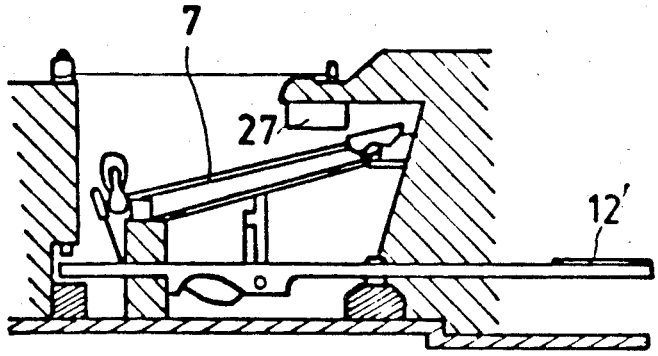
Figure 14C:
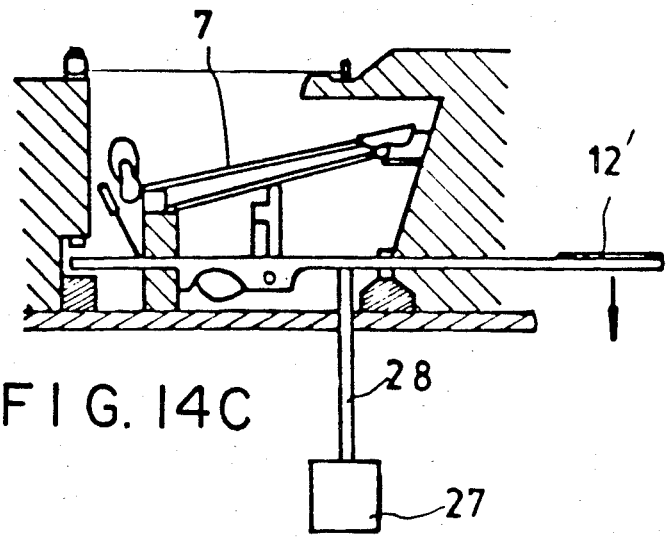

Referring to FIG. 14, there are shown several embodiments showing the different positions installed and the driving methods of the string-percussing hammer driving means (27) In FIG. 14(A) the string-percussing hammer driving means (27) is installed underneath the piano keys (12'). In FIG. 14(B) said driving means (27) is installed in a position near the fulcrum of the string-percussing hammer (7). In FIG. 14(C), said driving means (27) is installed underneath the piano key with a steel rod (28) and the said driving means (27) will indirectly drive the string-percussing hammer (7).

The other types of driving means are described, by referring to FIGS. 14 and 15, as follows:

In FIG. 15(A), the string-percussing hammer driving (27) is made of a rotary means (29) to drive, through a connecting rod (30) the corresponding piano key (12') and the string-percussing hammer (7) in the terminal piano. FIG. 15(B) shows a driving means made of a rack (31) and gear (32) which converts the output of a rotary means (29) into a linear motion to drive the key (12') of a terminal piano. The said rotary means (29) may be a small D.C. servo-motor, a printing circuit type of motor, or other rotary means that is driven with electromagnetic induction method or a fluid pressure. The said rotary means (29) may also be furnished with a return spring to have said means (29) returned to its original position upon being deenergised. FIG. 15(C) shows a cylinder driving means (18) as shown in FIG. 10(I) to be used as a string-percussing hammer (7). FIG. 15(D) shows a string-percussing hammer driving means (27) including a solenoid (33) having four sets of windings, which can directly drive the pinao keys (12') and the string-percussing hammer (7); said solenoid may also replaced with the printing circuit type of solenoid (25) or the general solenoid.

Figure 16:
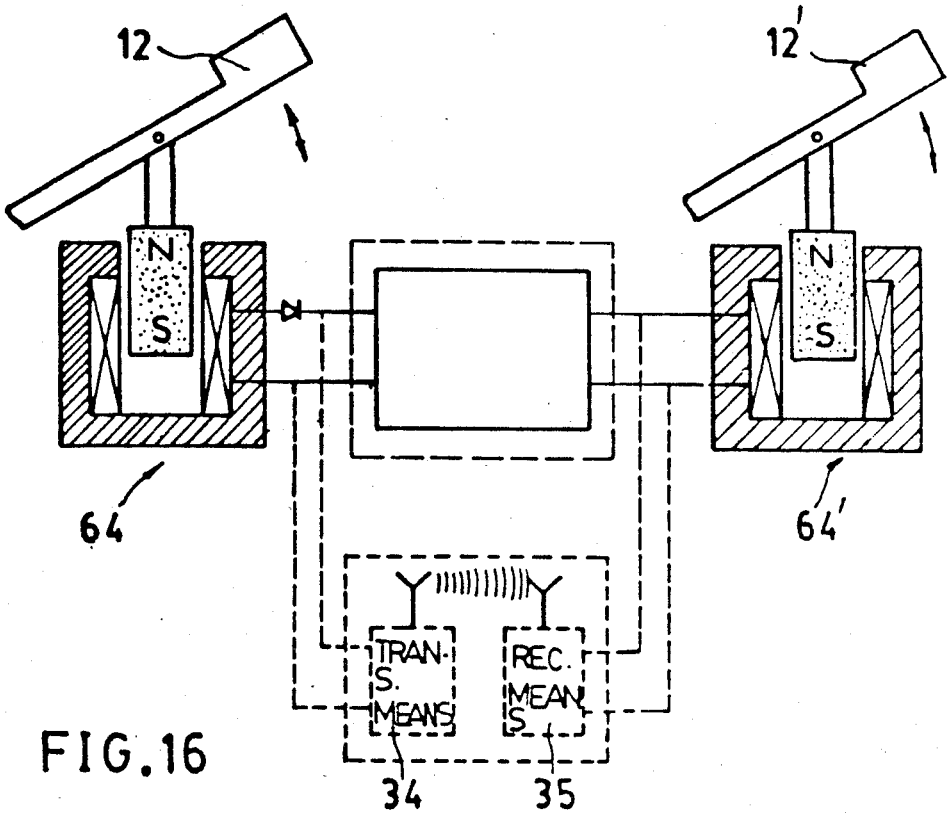
FIG. 16 is an embodiment showing how the string-percussing signal to be transmitted between the primary rendition piano and the terminal piano; in said Fig., only one means of transmitting the key operation signal sensed is shown.

Referring to FIG. 16, there is shown an embodiment to illustrate the transmission method between theprimary piano and the terminal piano in the present invention (only illustrating the transmission of the sensed signal of a given piano key operation), in which the string-percussing signal generator (3) of a given key (12') in the primary rendition piano is an electro-magnetic type of sensing means (64) and the string-percussing hammer driving means (27) in the terminal piano is an electro-magnetic driving means (64') same in construction as the said electromagnetic type of sensing means (64). Upon the piano key (12) in the primary rendition piano (1) being played, the sensing means (64) will generate an induced output of analog signal corresponding to the motion speed of the piano key (120). As shown by the solid line in FIG. 16, the said signal may also be transmitted, through a wire, to an amplifier for amplification before being transmitted through wire to a given terminal piano so as to drive the electro-magnetic type of driving means (64') in the key (12') having the same tone scale same as that in the key (12) of said piano being played in order to have the key (12') played automatically, and further to have the string-percussing hammer (7) corresponding to said key being actuated (referred to FIG. 14) to render the same music as that of the key (12) in said primary rendition piano.

Upon more than one keys (12) being simultaneously or continuously played, the same number of corresponding electro-magnetic sensing means (64) under each of the keys (12) will sense and generate the corresponding output signal, which will, after being amplified, drive the same number of corresponding electro-magnetic driving means (64') to generate the corresponding string-percussing operation.

Referring again to FIG. 16, there is shown a dotted line indicating that said string-percussing siganl sensed may be transmitted to a transmission means (34) (being used as a string-percussing signal transmission circuit and processing circuit 4) for amplification and for FM, AM or PCM modulation before putting into radio transmission; then, said signal will be received by a receiving means (35) (being used as a string-percussing signal receiving circuit 5) for de-modulation and amplification so as to drive the electro-magnetic driving means (64') to generate rendition. Further, said signal sensed may also be transmitted to a domestic earth station for relaying to the earth station of other country via satellite communication system, and then the signal will be transmitted through said earth station to a terminal piano to generate the corresponding remote rendition result.

The aforesaid piano key (12') and string-percussing hammer (7) may be pulled back to its original position by means of a convention returning spring of its gravity.

Figure 17:
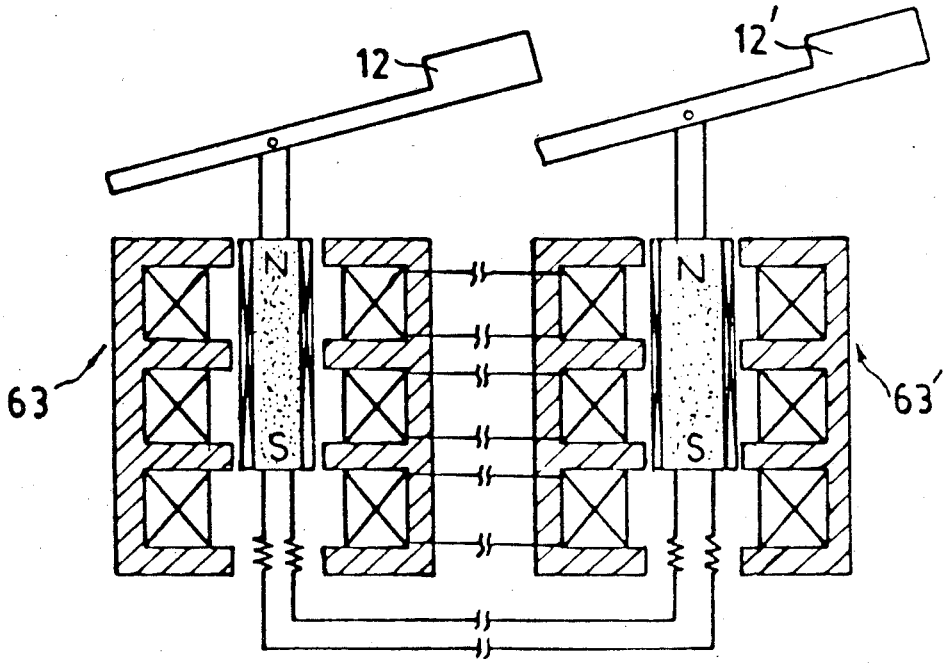
FIG. 17 is an embodiment showing the string-percussing signal to be transmitted directly to the terminal piano by means of wire.

Referring to FIG. 17, there is shown another string-percussing signal transmission method, in which the sensing means in the primary rendition piano and driving means in the terminal piano are all the same as a mechanical-to-electric energy transducer (63) having three windings as shown in FIG. 13. By means of said winding to be energised in sequence, a better fidelity of the rendition signal may be obtained. The sensing and the transmitting theory of said method shown in FIG. 17 is the same as that shown in FIG. 16 (in FIG. 17 only the wire transmitting method being shown). Upon being transmitted directly through wire, every said winding will have a common ground, and each winding forms a separate wire transmission system directly. In addition, a switch transistor may be connected in series with each transmission wire, and said switch transistor may be constolled with an oscillator and a ring-shaped counter for scanning transmission method (to be described in FIG. 31 later). The RF transmission may be done by means of the various scanning method to be described later (refer to FIGS. 32 to 34).

In addition to the various driving means shown in FIG. 10 for directly or indicrectly driving the string-percussing hammer (7) in the terminal piano, the string-percussing means (6) may also be furnished with a servo-control function so as to timely adjust the driving strength of the string-percussing signal to the string-percussing hammer driving means (27) for increasing the fidelity of the music; then, the string-percussing means (6) becomes a "servo-string-percussing means", and the terminal piano will also become a terminal servo-piano having the function of string-percussing servo-control.

Figure 18:
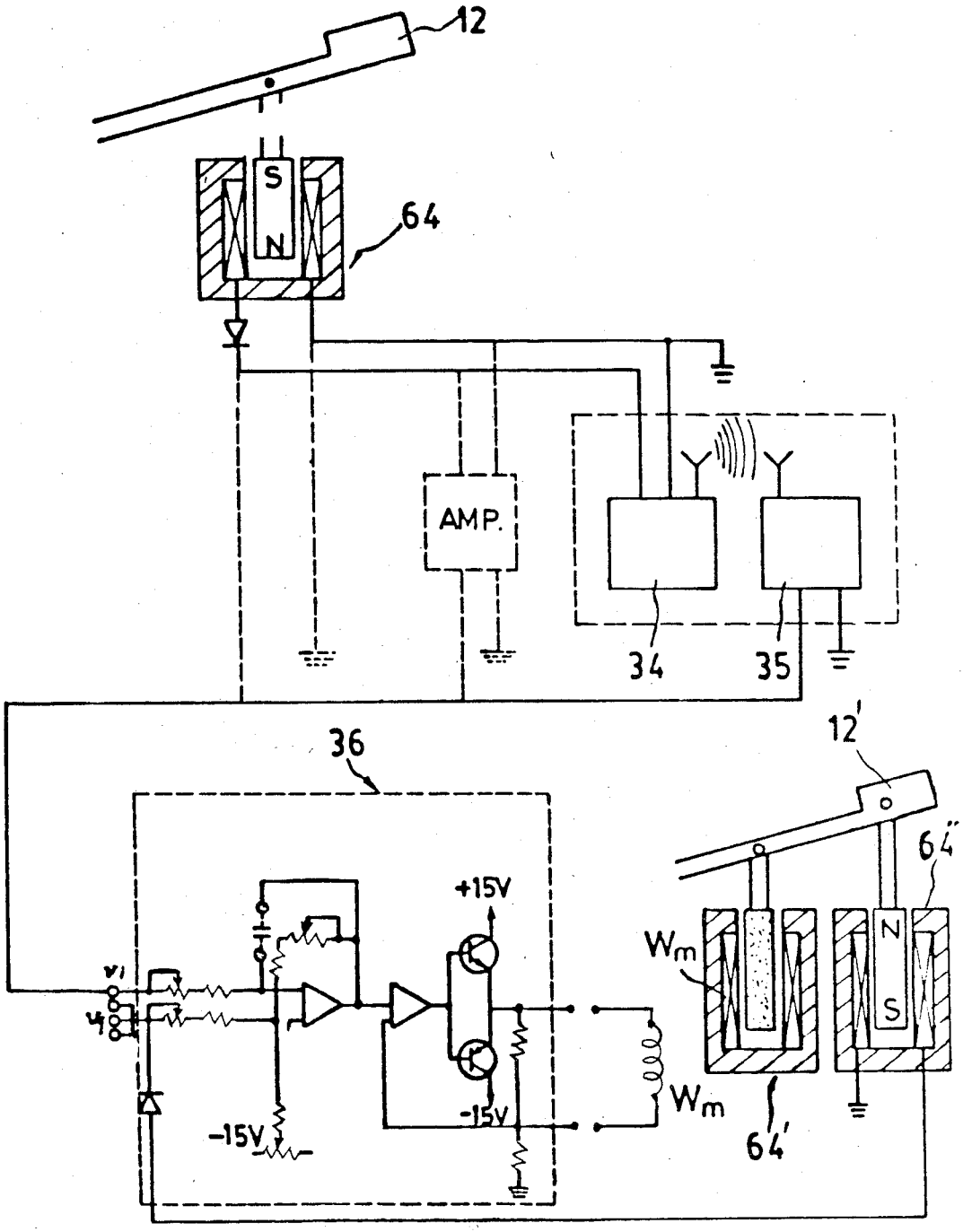
FIG. 18 is an embodiment of a servo-amplifier in the servo-string-percussing means, being used for adjusting the driving strength of the string-percussing hammer driving means.

The aforesaid means is further described, by referring to several embodiments, as follows:

Referring to FIG. 18 there is shown an embodiment, of which the feature is that a servo-amplifier (36) is to be driven with the signal transmitted through a wire system or an electro-magnetic wave, also the output of said servo-amplifier (36) may be used to drive the electro-magnetic type of driving means (64') having a winding $W_m$) that is used a a string-percussing hammer driving mens (27). Another electro-magnetic sensing means (64'') same as the electro-magnetic sensing means (64) is also coupled to the lower end of the key (12') of a terminal piano so as to generate a sensing signal $V_f$ upon the key (12') being driven to feed back to the input terminal of the said servo amplifier (36) and so as to compare with the string-percussing signal $V_i$ coming from the electro-magnetic sensing means (64) of the primary rendition piano in order to adjust the driving strength of the electro-magnetic driving means (64').

Figure 19:
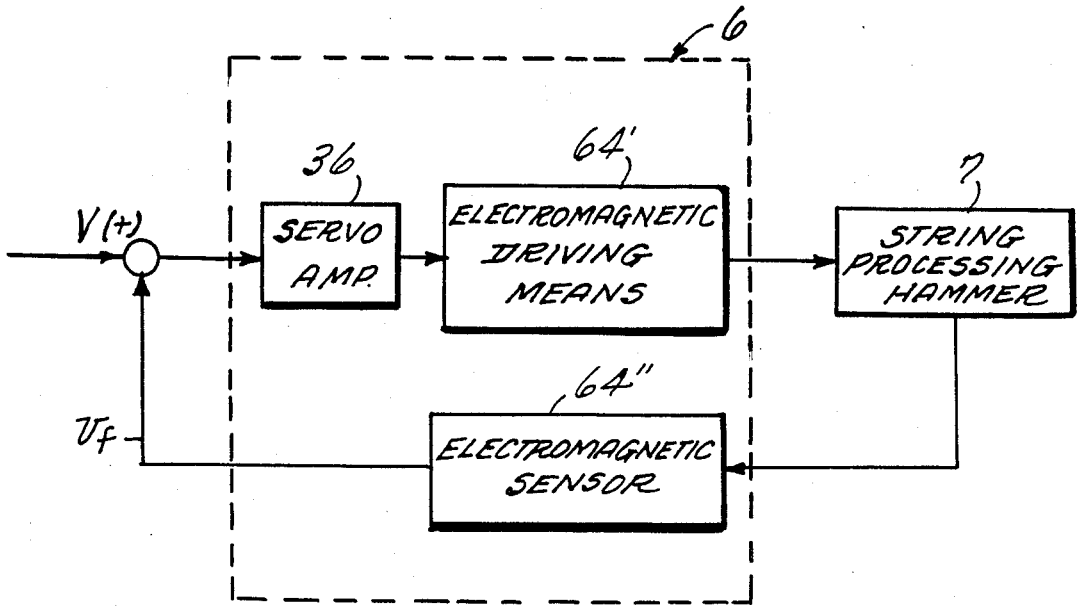
FIG. 19 is ghe block diagram of the servo-system shown in FIG. 20.

FIG. 19 is a block diagram showing the servo-driving system as illustrated in FIG. 18.

Figure 20:
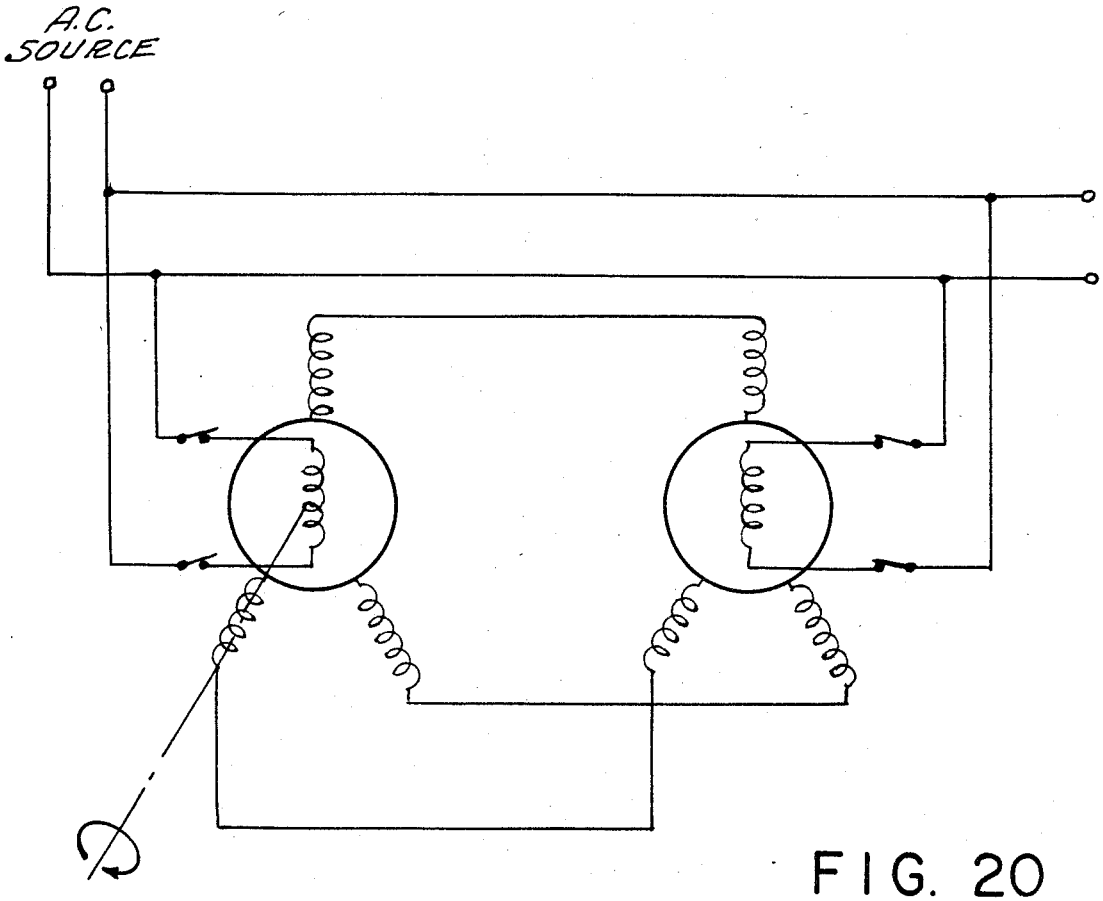
FIG. 20 shows an A.C. synchronizer being used as a sensing and driving means.

FIG. 20 is an A.C. synchroniser to be used as a string-percussing signal generator (3) and a string-percussing hammer driving means (27) in the present invention.

Figure 21:
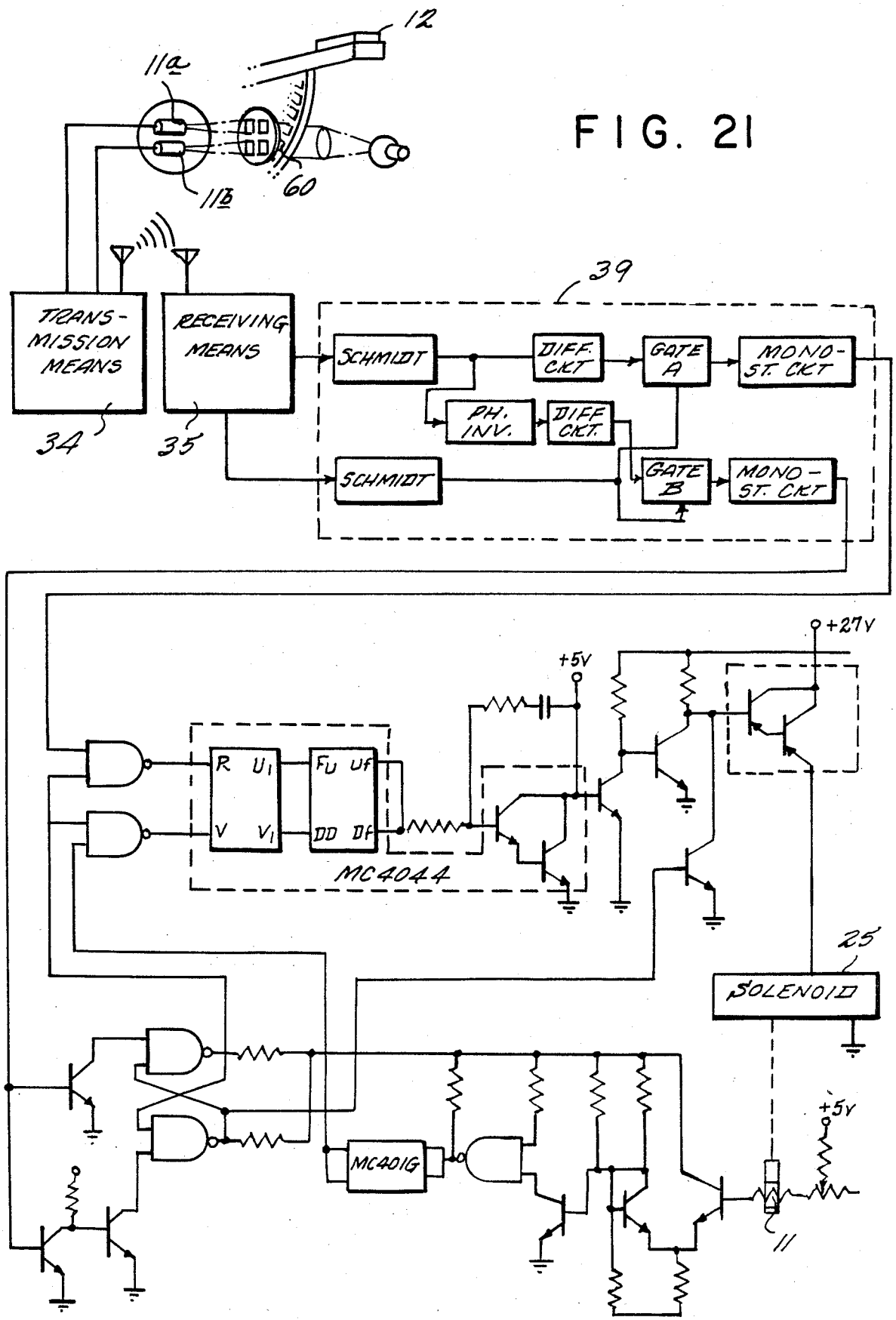
FIG. 21 shows the photocell sensing means shown in FIG. 5 to be used as a string-percussing signal generator, and also shows the printing circuit solenoid shown in FIG. 11 to be used as the string percussing hammer driving means.

FIG. 21 shows two embodiments, of which one is the photo-cell digital sensing means shown in FIG. 5 to be used as a string-percussing signal generator (3) while the other is the printing circuit solenoid (25) shown in FIG. 11 to be used as a string-percussing hammer driving means (27).

Upon the key (12) being pushed down to drive the round plate (60) having fine slit groups rotating, the two photodetectors (11*a*) and (11*b*) having an angle difference of 90° will generate two photocell signals, which are added or opposite each other, and which are coupled to a moving direction-identifying circuit (39) same as that shown in FIG. 5(D), said circuit (39) can only generate a pulse output upon the piano key (12) being pushed down. Said signal will also be coupled t a driving circuit (including a MC 4044 IC) that has digital control, D/A converter, and amplification functions so as to drive the printing circuit solenoid (25) in a terminal servo piano to have the string-percussing hammer generate a corresponding operation. The operation of the string-percussing hammer (7) may be sensed by a photocell sensing means (only including a photodetector same as that mentioned above, and the signal sensed will be fed back to the input terminal of said driving circuit. The feature of this embodiment is to obtain high fidelity by means of the high frequency response of the printing circuit solenoid, and by means of the driving circuit having digital control function.

FIG. 22 is a servo-block diagram of the embodiment shown in FIG. 21.

In the embodiment of the servo-block diagram shown in FIG. 23(A), a resolver (41) is used as a displacement sensing means of the string-percussing hammer in a terminal servo-piano, and another phase servo-control method is used for controlling the string-percussing servo-system of the terminal servo-piano. FIG. 23(B) is used for illustrating the relationship between the input signal $P_r$, the input signal $P_O$ and the output signal $P_r$–$P_O$ of the phase discriminator circuit. The PPM shown in FIG. 23(B) is the digital phase modulator shown in FIG. 23(A).

FIG. 24(A) is an embodiment showing to use a steel rod (28) (may be made of other metal) to indirectly pull the string-percussing hammer (7) said steel rod (28) may also be pulled up and down by means of a hydraulic cylinder (18) as shown in said Fig., or a pneumatic or an electro-magnetic driving means or the aforesaid printing circuit solenoid. Further, said steel rod (28) may also be driven with a rotary driving means that drives a winding wire (70).

Referring to FIG. 25, there is shown a string-percussing servo-method, which uses a hydraulic cylinder (18) to drive the string-percussing hammer; a differential transformer sensing means (43) may be used to sense the displacement of the plunger (42) so as to feed back to the driving input terminal of the cylinder (18) in which a servo-valve (44) is used for controlling the oil to flow in or out.

FIG. 26(A) is a block diagram showing the basic structure of te servo-valve (44) shown in FIG. 25.

FIG. 26(B) illustrates the construction relationship among the servo-valve (44), the servo-amplifier (45) and the said plunger displacement sensing means (43). The position control of the string-percussing hammer to be controlled with said hydraulic servo control means may be illustrated with a block diagram shown in FIG. 27.

Figure 28:
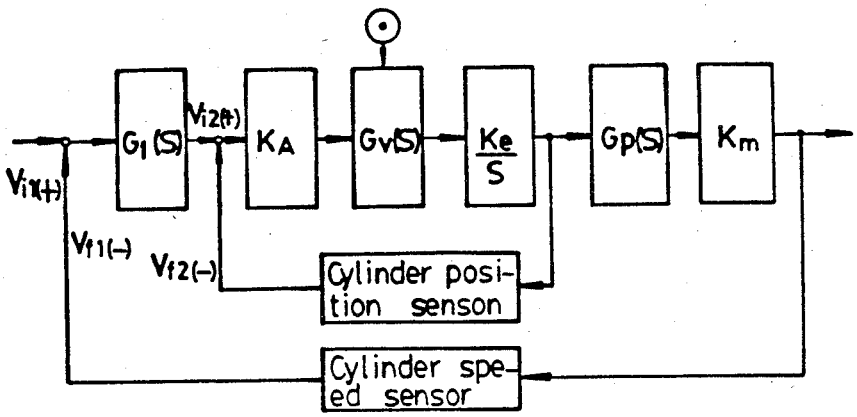
FIG. 28 is a block diagram of the servo-string-percussing means, in which two sensing means are used for sensing the speed and position of the hydraulic cylinder shown in FIG. 25A.

The hydraulic driving method shown in FIG. 28 uses two sensing means as shown in FIG. 25(B) and 27 to sense the position and speed of the output axle of said hydraulic cylinder (18) respectively, then said position and speed sensed will be fed back to the input terminal for servo-control. It is a semiclose loop type of control method.

In playing piano, the player generally will simultaneously play a plurality of keys; therefore, the sensing means for each kay should be able to generate and to deliver an output signal simultaneously. The following embodiments will describe how the string-percussing signal generator (3) and the transmission and processing circuit (4) in this system accomplish the aforesaid requirements.

Figure 29:
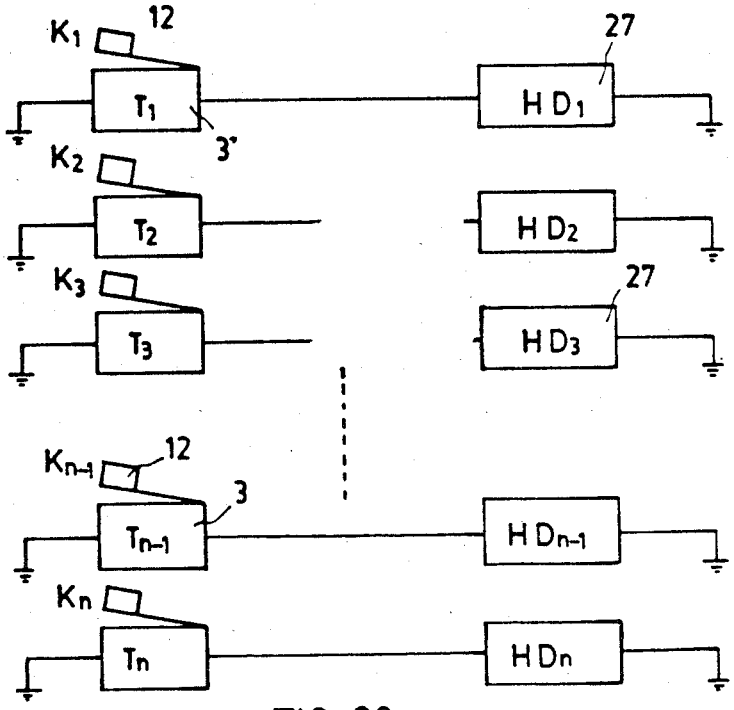
FIG. 29 is an embodiment to illustrate the string-percussing signal to be directly transmitted through the wire.

Referring to FIG. 29 there is shown an embodiment of direct transmission, in which the operation of the keys (12) ($K_1$–$K_n$) of the primary rendition piano will be sensed respectively with the corresponding string-percussing signal generator (3) ($T_1$–$T_n$) and will be directly, through wire, transmitted to the corresponding string-percussing hammer driving means (27) '$HD_1$–$HD_n$).

Figure 30:
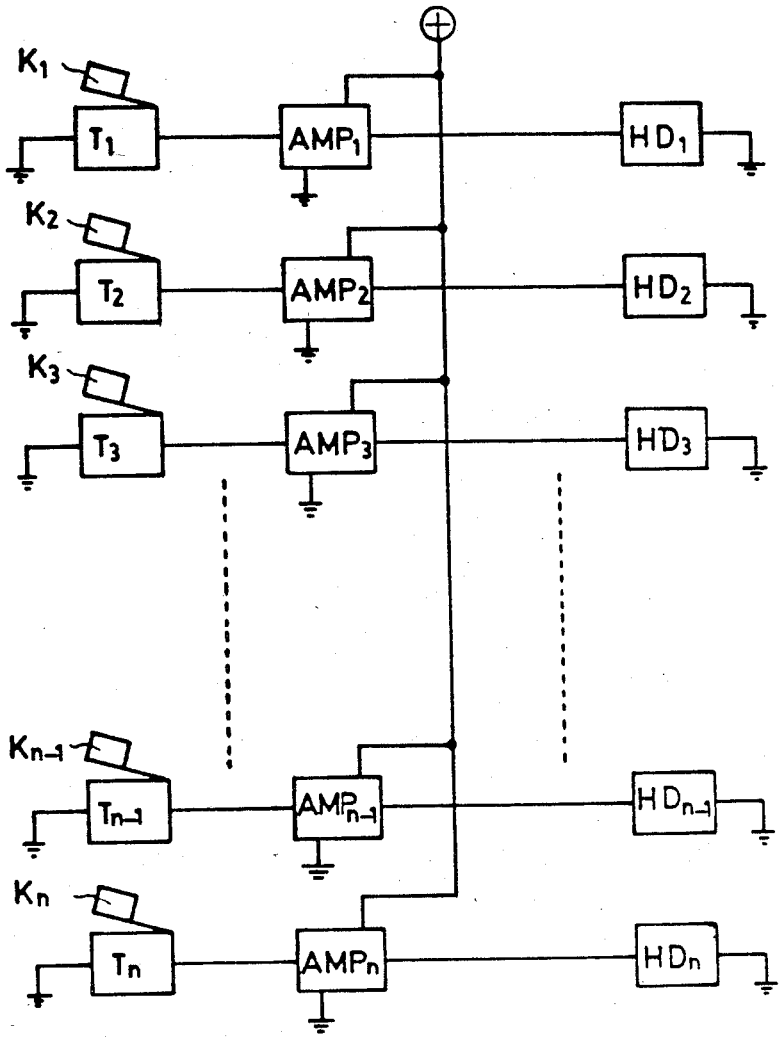
FIG. 30 shows a transmission method, in which a linear amplifier is installed on each transmission wire.

The embodiment shown in FIG. 30 is furnished, in the transmission wire, with a linear amplifier $AMP_1$–$AMP_n$.

Figure 31:
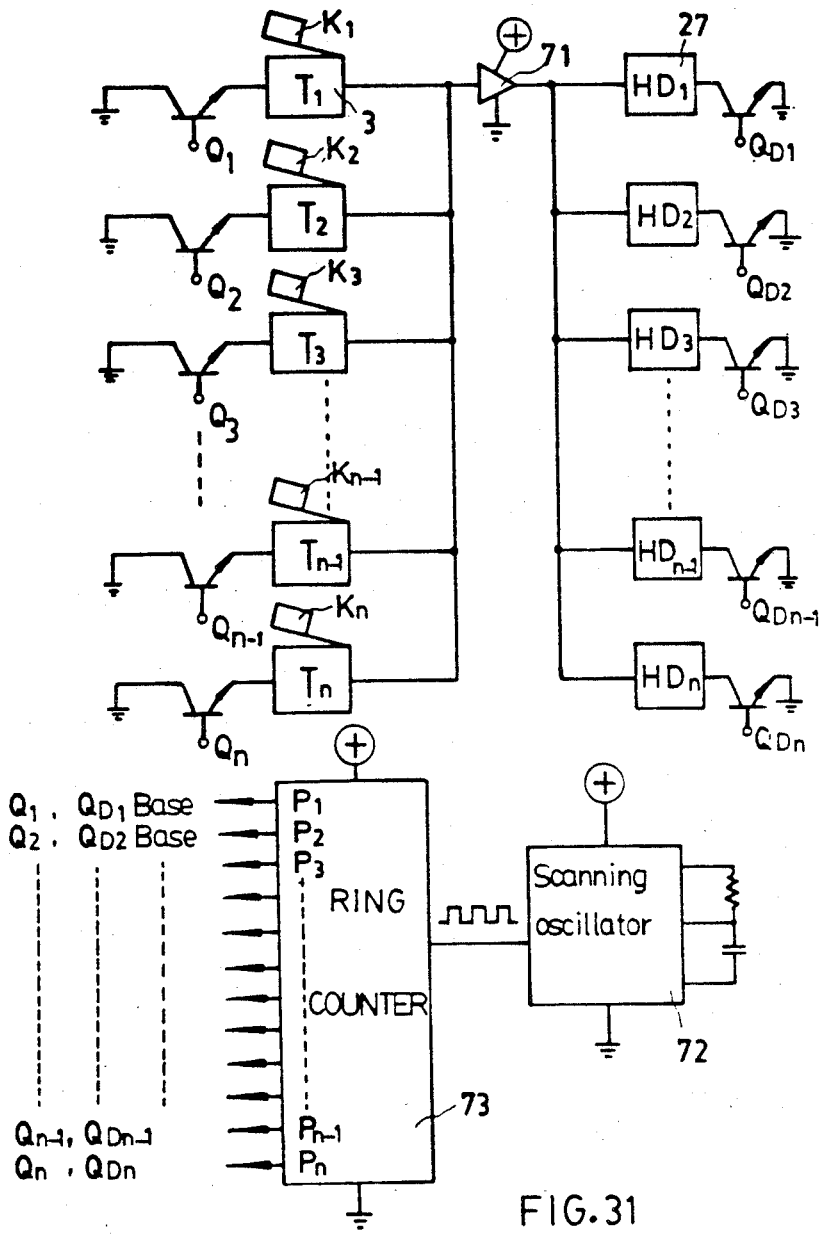
FIG. 31 is an embodiment to directly transmit the string-percussing signal by means of a multi-tone and single line scanning method.

The aforesaid wire transmission method is this system is just the multi-tone and single line scanning type of direct transmisson method as shown in FIG. 31, in which the grounding terminals of the string-percussing signal generators ($T_1$–$T_n$) are connected, in series, with a switching transistor $Q_1$–$Q_n$ respectively; the output terminals $T_1$–$T_n$ are connected in parallel and coupled to one amplifier (71). At the grounding terminal of every string-percussing hammer driving means $HD_1$–$HD_n$ of the terminal piano, a switching transistor $Q_{D1}$–$Q_{Dn}$ is also connected in series recpectively. The input terminals of $HD_1$–$HD_n$ are connected in parallel, and then coupled to the output terminal of said amplifier (71). Further, in the string-percussing signal transmission and processing circuit (4) a time sequence oscillator (72) and a ring counter (73) are furnished. The output terminals ($P_1$–$P_n$) of said ring counter (73) are connected respectively to the basis of the aforesaid switching transistors ($Q_1$–$Q_n$; and $Q_{D1}$–$Q_{Dn}$); in other words, the output point $P_1$ is used fo driving $Q_1$ and $Q_{d1}$; $P_2$ is used for driving $Q_2$ and $Q_{D2}$; likewise, $P_n$ is used for driving $Q_n$ and $Q_{Dn}$ so as to have the operation of $K_1$–$K_n$ generate a scanning type of multi-tone output.

Figure 32:
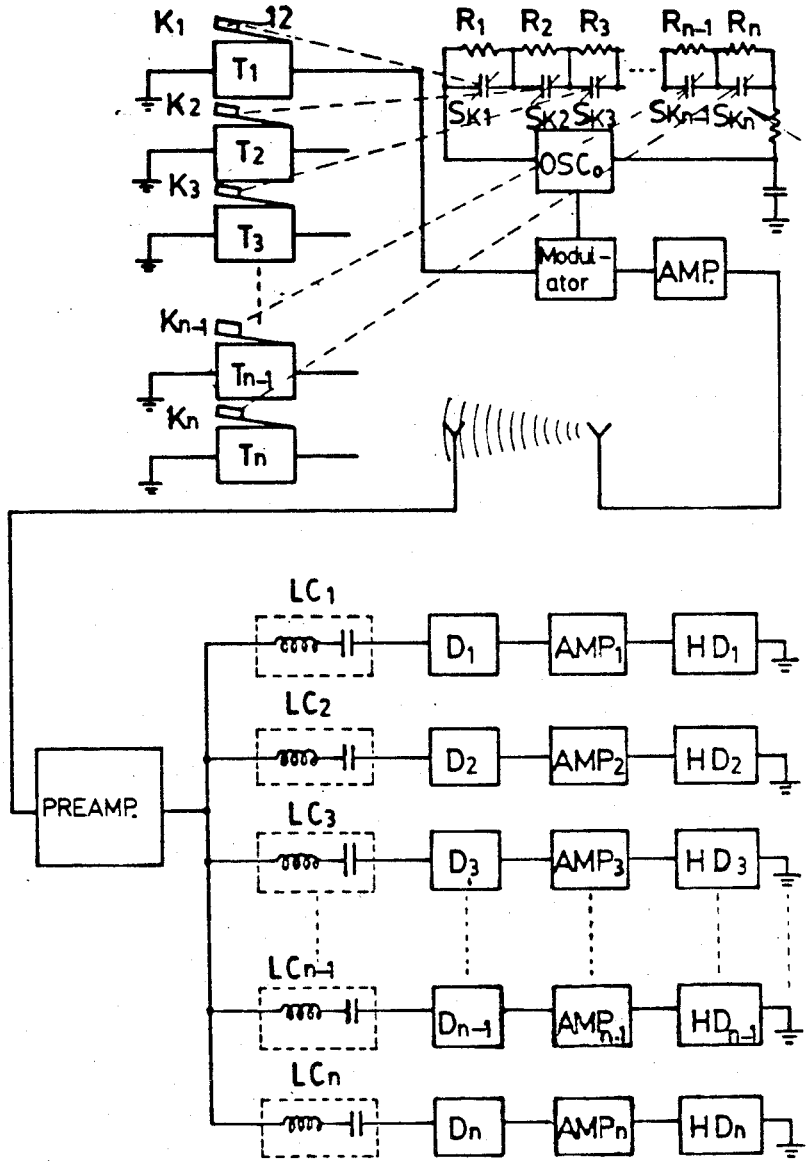
FIG. 32 is an embodiment of radio transmission by means of single-tone frequency modulation method.

FIG. 32 is an embodiment of radio transmission in a single-tone frequency modulation mode to be used in this system. Referring again to FIG. 1, there is shown an oscaillator in the string-percussion-signal transmission and processing circuit (4) and the oscillating frequency of said oscillator is to be determined by the resistance value of the resistors $R_1$–$R_n$ which are connected respectively in parallel to every normally closed contact of the switches $S_{K1}S_{Kn}$ coupled to the keys $K_1$–$K_n$. For example, upon $K_1$ being played, the normally closed contact coupled to $K_1$ will become opening to have the oscillator generate oscillating at a frequency determined by $R_1$. Said oscillating signal and the signal generated by $T_1$ are all coupled into the modulator, and will be transmitted to other place after being amplified. Since the resistor of every key is $R_1 \neq R_2 \neq R_3 \ldots \neq R_{n-1} \neq R_n$, the transmitting frequency is different from each other; therefore, the various resonant circuits LC in the terminal piano will have a selection to the input signal frequency. Since all the resonant frequencies $f_{LC1}$–$f_{LCn}$ of the resonant circuits $LC_1$–$LC_n$ have been pretuned to the same frequencies of said corresponding OSC. of every key, only the LC circuit ($LC_1$–$LC_n$) of the corresponding key ($K_1$–$K_n$) being played can generate a resonance and generate an input. The said input signal will pass a detector ($D_1$–$D_n$) for detection, and pass an amplifier ($AMP_1$–$AMP_n$) for amplification so as to drive the corresponding string-percussing hammer driving means $HD_1$–$HD_n$ to actuate the string-percussing hammer coupled thereto.

Figure 33:
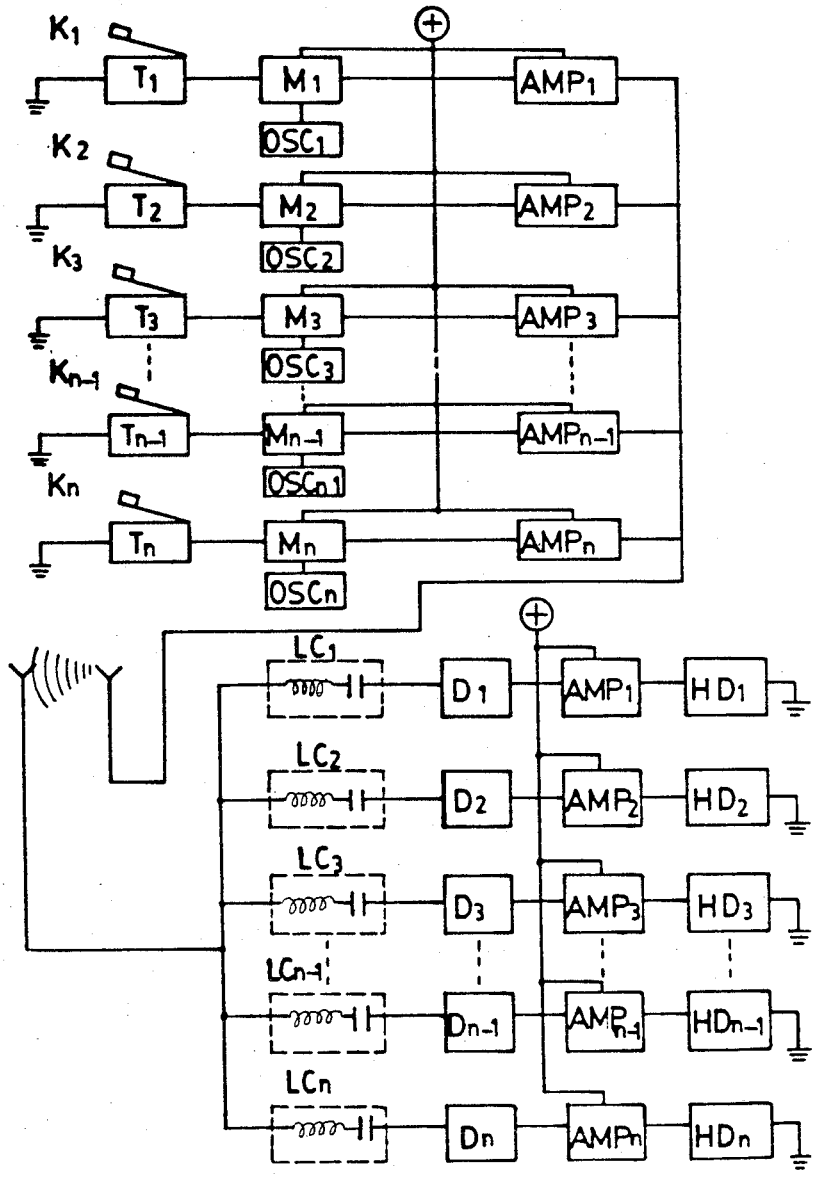
FIG. 33 is an embodiment, in which a multi-channel radio transmission method is used for transmitting the tones of the keys simultaneously.

FIG. 33 is an embodiment of a multi-channel radio transmission method for the remote control rendition system, in which the notes generated by every key may be transmitted simultaneously. The feature of that system is that every key $K_1$–K has its discrete modulator $M_1$–$M_n$ oscillator $OSC_1$–$OSC_n$, and amplifier $AMP_1$–$AMP_n$ so as to have the signal generated by each key transmitted simultaneously to the terminal piano.

Figure 34:
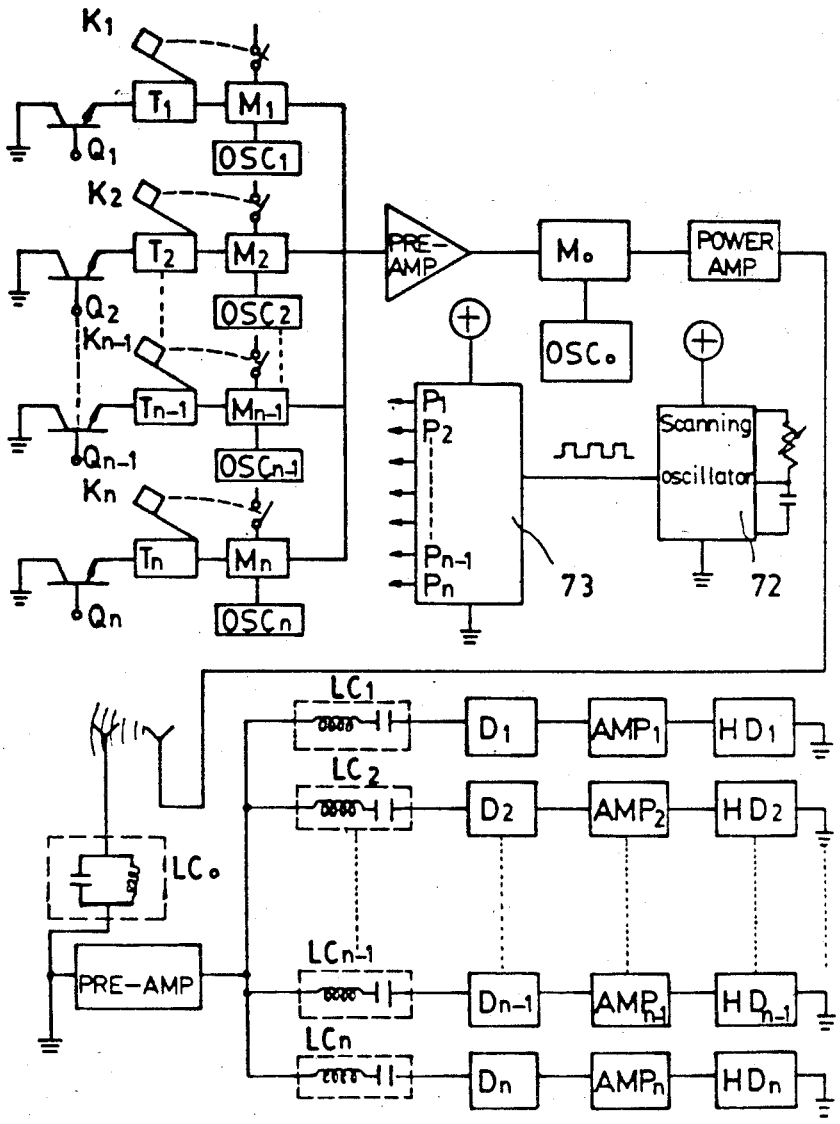
FIG. 34 is an embodiment, which uses a scanning method of single channel transmission to transmit the string-percussing signal.

FIG. 34 is an embodiment of a scanning type of single channel transmission method, in which the grounding eterminal of every key $K_1$–$K_n$ as shown in FIG. 33 is connected in series to a switching transistor $Q_1$–$Q_n$, and then the outputs of all modulators $M_1$–$M_n$ are connected in parallel. The keys $K_1$–$K_n$ and the corresponding switches $S_1$–$S_n$ are operated simultaneously so as to trigger, upon the key $K_1$–$K_n$ being pushed downwards, the corresponding $M_1$–$M_n$ and $OSC_1$–$OSC_n$ and to have the string-percussing signal passed from the parallel output terminals of $T_1 \propto T_n$ to the pre-amplifier, and to the coupled to a modulator Mo together with a RF signal generated by an oscillator OSCo at a frequency $f_{OSCo}$; the signal is then amplified and transmitted. In addition, a scanning oscillator at a scanning frequency of $f_{OSC}$ is installed to furnish scanning signal to a ring counter, of which the output terminals $P_1$–$P_n$ are connected respectively to the basis of $Q_1$–$Q_n$. The relationship among the aforesaid frequencies is: $f_{OSC1} > f_{OSC2} > f_{OSC3} \ldots > f_{OSCn-1} > f_{OSCn}$ and $f_{OSCo} > f_{OSC1} > -f_{OSCn} > f_{OSC} > (f_{OSC1} - f_{OSCn}$ are the corresponding frequencies of the oscillators $OSC_1$–$OSC_n$.

In addition to adding a resonant circuit LCo (a resonant frequency fLCo equal to $f_{OSCo}$) in the front portion of the receiving device to receive the RF of $OSC_o$, a pre-amplifier may be added, if necessary, before connecting to the parallel terminal of the resonant circuit $LC_1$–$LC_n$ that are used for selecting the various input string-percussing signals.

Figure 35:
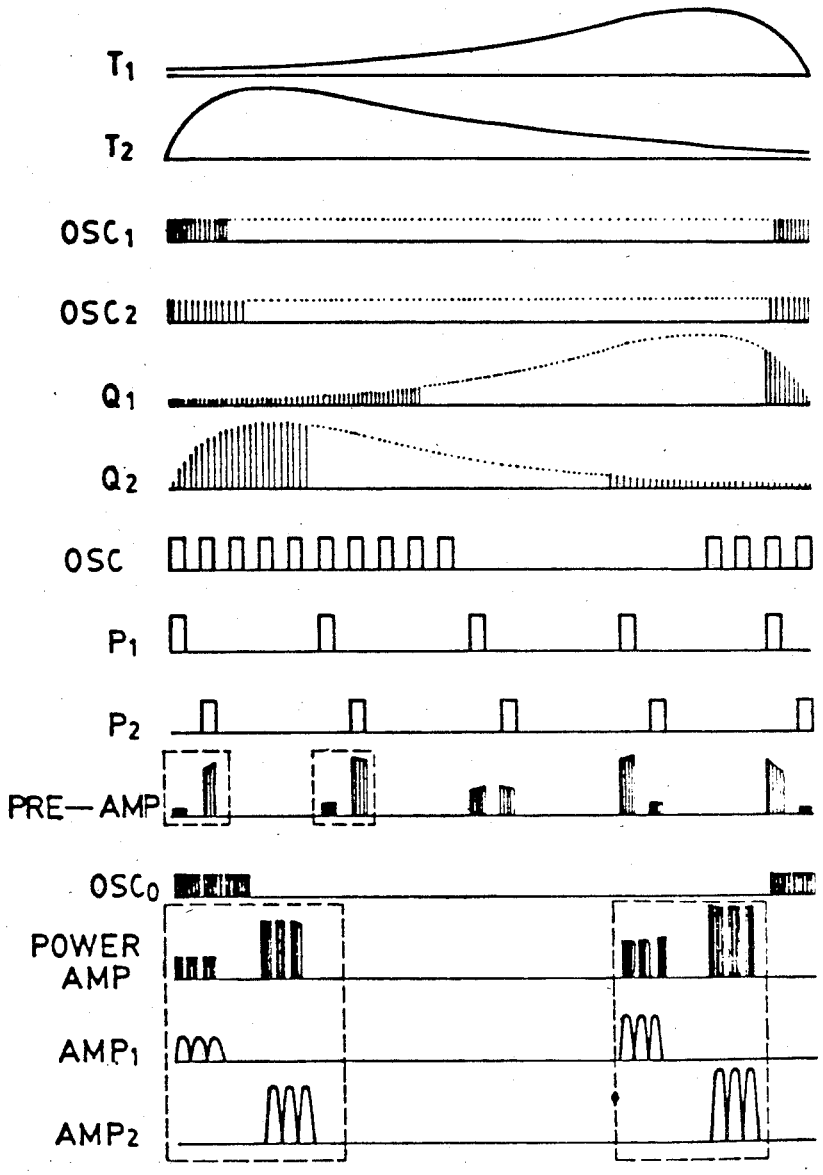
FIG. 35 shows the wave forms on the various points of the transmission and reception system shown in FIG. 34.

Owing to the presence of the following relationship:

$$f_{LCo} = f_{OSCo}$$
$$f_{LC1} = f_{OSC1}$$
$$f_{LC2} = f_{OSC2}$$
$$\vdots \qquad \vdots$$
$$f_{LCn} f_{OSCn}$$

a signal after being preamplified and passing through the resonant circuit $LC_1$–$LC_n$ for selecting a key in the terminal piano, and then passing through the detector and amplifier to couple to the string percussing hammer driving means will reflect, with its amplitude, the same fingering skill of the player at the primary rendition piano. The relationship among the signals is illustrated in FIG. 35. In the embodiments shown in FIGS. 29, to 33, a group of switches $S_1$–$S_N$ may, if necessary, be installed in the keys $K_1$–$K_n$ as shown in FIG. 34 so as to turn on the power supply of the detector, the oscillator, the modulator, or the amplifier to generate the functions thereof upon the key being pushed down in order to reduce power consumption.

Moreover, in the present invention, the operation of pedal operated manually to generate forte and pianissimo, tremolo, and liaison may also be sensed and converted to a signal by means of electro-mechanical or photocell contact or the aforesaid string-percussing signal generator, and then said signal will be transmitted to the terminal piano by means of the aforesaid method of transmitting the string-percussing signal. The driving means to generate the aforesaid functions in the terminal piano may also be selected out of the aforesaid driving means to be used for string-percussing means. Upon transmitting and scanning, the said signal may be encoded and processed together with the string-percussing signals of the keys, but the driving means in the terminal piano is the conventional mechanism used for converting the aforesaid functions.

In brief, the aforesaid signal processing method will enable the said piano having the various novel functions and a "group" rendition mode which are to be described later.

Figure 36:
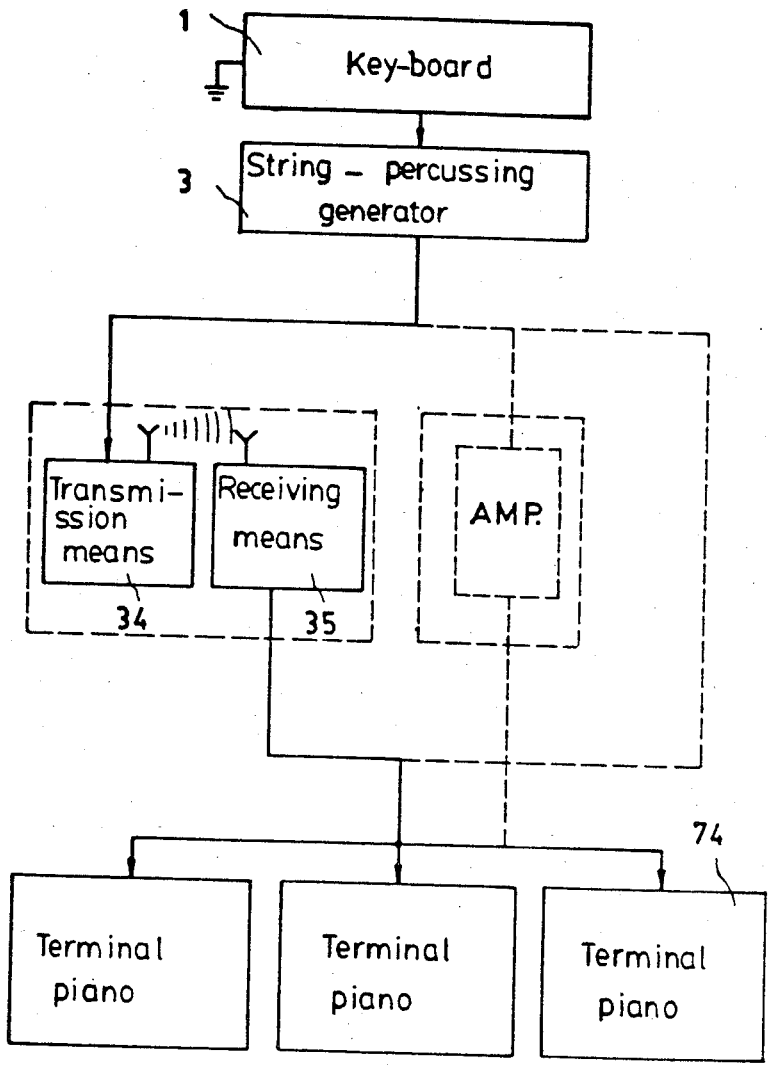
FIG. 36 is a block diagram showing a parallel and remote rendition system by using one piano or one group of key board.

For example, in FIG. 36, the output signal of thekey on the key-board (1) may be used for driving two or more than two terminal pianos (74) simultaneously by means of the various transmission methods illustrated in FIG. 29 to 34 (the transmission methods illustrated in FIGS. 29 and 30 are indicated with dotted lines in said FIG. 36).

Figure 37:
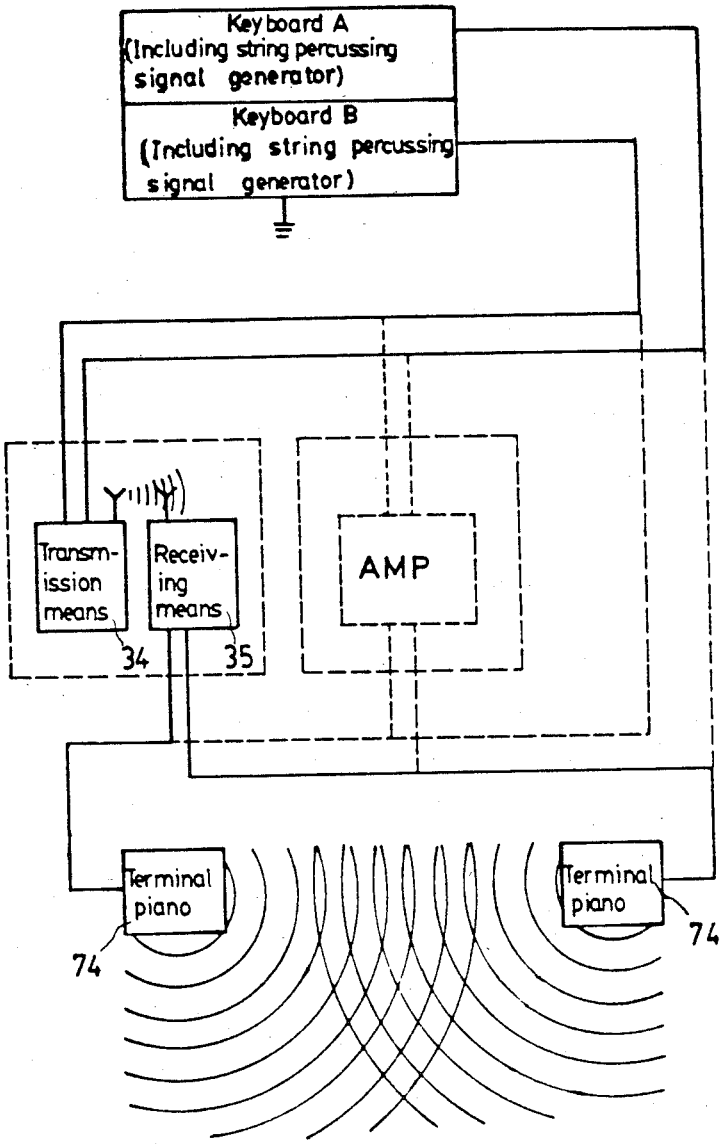
FIG. 37 is a block diagram of remote rendition system by using two groups of key boards and two terminal pianos installed at two opposite sides.

FIG. 37 is a further mode in using the present invention, which includes two sets of key-boards and two pianos arranged abreast or two "groups" of terminal pians (74) (each group including more than one terminal piano); underneath the keys of each key-board, a string-percussing signal generator (3) is installed, and each terminal piano (74) is furnished with the string-percussing means (6). In rendition, the combined forte point generated by the two terminal pianos arranged abreast or two "groups" of terminal pianos may generate a linear displacement effect.

Figure 38:
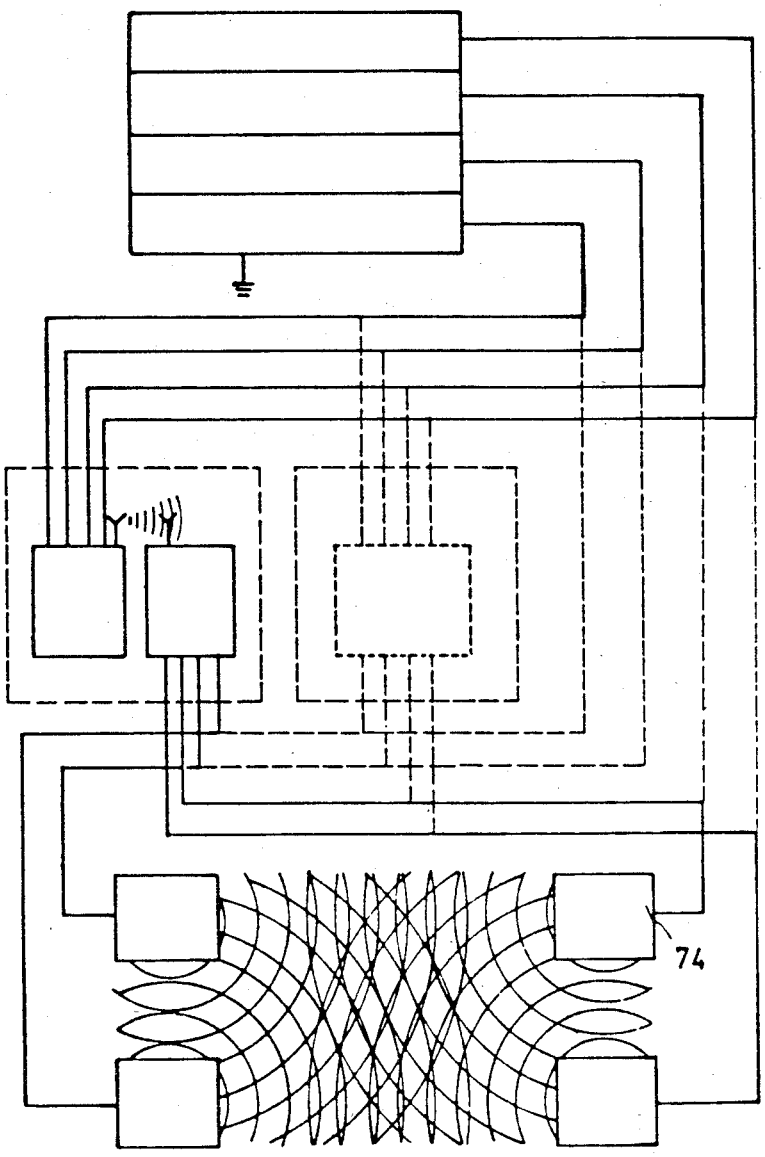
FIG. 38 shows a parallel and remote rendition system by using four groups of key boards and four terminal pianos arranged in the four corners of a square area so as to have the forte point of bombined sound generate a double coordinate displacement.

The system shown in FIG. 38 comprises four key-boards and four terminal pianos or four groups of terminal pianos (74) arranged in four corners or a square or rectangular floor. In rendition, the key-boards may be applied with different percussing strength so as to have the terminal pianos (74) in four corners generate a combined forte point that can have horizontal and vertical displacement on a coordinate plane so as to obtain a four channel effect.

Figure 39:
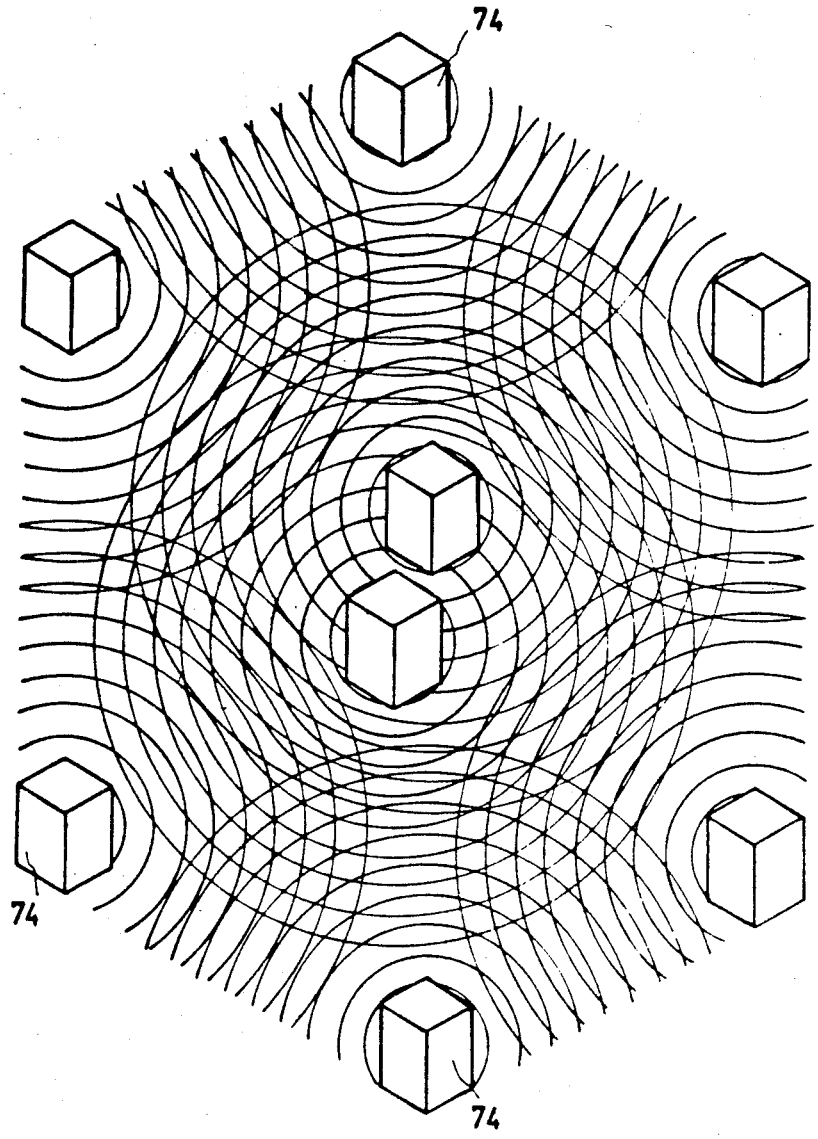
FIG. 39 shows eight terminal pianos being arranged in cubic configuration to receive the rendition control from eight discrete groups of key boards so as to have the forte point of combined sound generate a stereo-displacement effect.

FIG. 39 is a system including eight terminal pianos or eight groups of terminal pianos (74) arranged in the corners of a cubic space so as to receive the renditions from eight key-boards (not shown). The different percussing force applied to the keyboards will generate a three dimensional forte point displacement in a given fixed point in said cubic space so as to form a stereo effect.

The aforesaid stereo effect not only can be obtained by means of separately, playing said two or more than two sets of keyboards to generate a variable combined forte point, but also can be obtained by playing a single keyboard which is installed with a separate forte point control means to control the string-percussing strength of every terminal piano so as to generate a variable displacement of the combined forte point.

The aforesaid forte point control means may be operated manually or mechanically so as to have the combined forte point make linear displacement, or two-dimensional displacement, or three-dimensional displacement (e.g. using handle, or pedal, or other type of control means) in order to proportionally control the signal transmitted to the various string-percussing systems (or the servo-string-percussing system) and to generate a combined forte point displacement in the various terminal pianos (or the terminal servo-pianos). The said function may be obtained by means of the control mechanism of the aforesaid control means being coupled to an analog or digital sensing means (a differential potentiometer type, or an induction type or a photocell type as shown in FIG. 3) to generate a corresponding signal upon said control means being operated, and said signal is then coupled into a "distribution circuit of string-percussing strength" which distribute the strength suitably to the string-percussing signal coming from the single set of keg-board. The sensing signal after being distributed will be transmitted to the string-percussing hammer driving means in the terminal pianos so as to generate the notes having different strength corresponding to the strength of signal received in the terminal pianos. Upon the control means of said forte point being continuously operated in various modes, the combined forte point formed by the various fortes and pianissimos of various terminal pianos will generate a linear displacement, two-dimensional displacement, or three-dimensional displacement.

Figure 40:
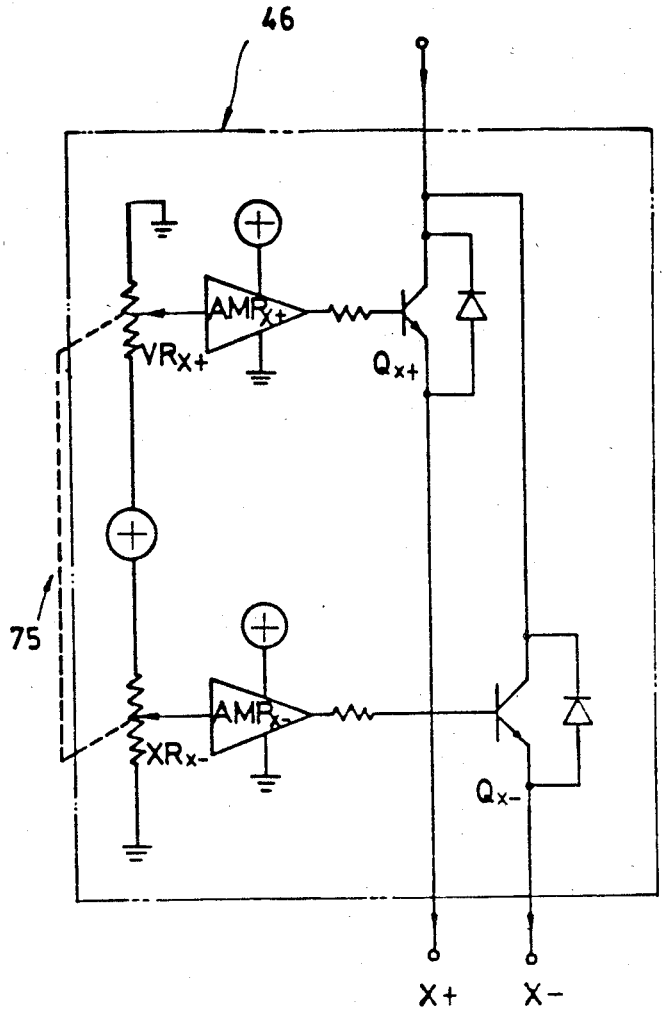
FIG. 40 is a distribution circuit of string-percussing strength to control the linear displacement of the forte point of combined sound of the terminal pianos.
Figure 41:
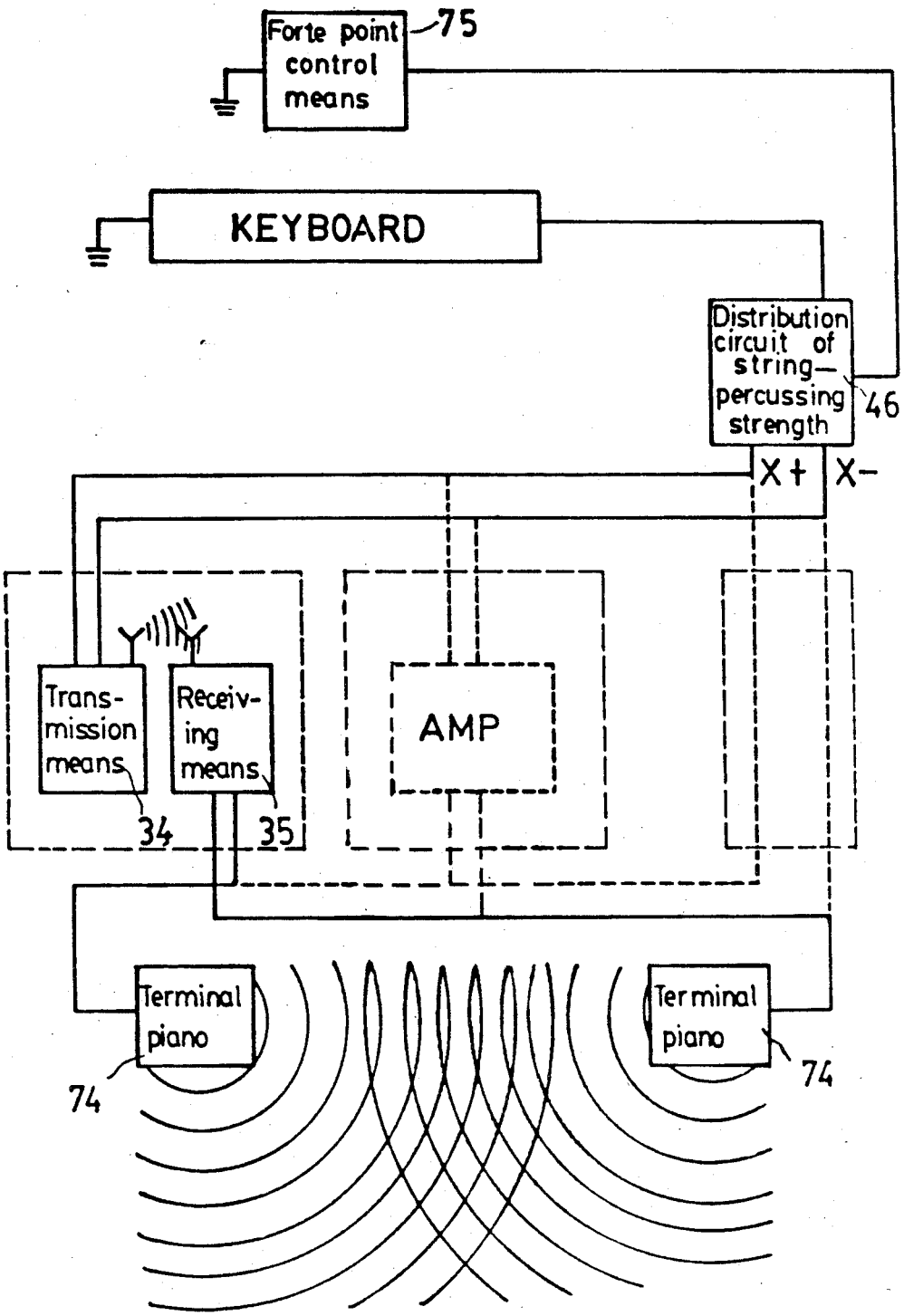
FIG. 41 is a block diagram of the remote rendition system in the present invention including that circuit shown in FIG. 40.

FIG. 40 is a distribution circuit of string-percussing strength to control the combined forte point makine linear displacement. In that circuit, the input terminals of the two amplifiers $AMP_{X+}$ and $AMP_{X-}$ are connected respectively to the output terminals of the differential potentiometer type of position sensing means $V_{RX+}$ and $V_{RS-}$. The bases of the two transistors $Q_{X+}$ and $Q_{X-}$ are controlled respectifely with said $AMP_{X+}$ and $AMP_{X-}$, and the collectors of said transistors being connected in parallel are coupled to the parallel output terminals of the string-percussing signal (for instance, in FIG. 34, said terminals being $M_1$–$M_n$). In operating the forte point control means (75) the output potential of the potentiometers $V_{RX+}$ and $V_{RX-}$ will have a synchronous but reverse increase or decrease, i.e. upon the output potential of $V_{RX+}$ being increased, the output potential of $V_{RX-}$ will simultaneously be decreased, and vice versa. The aforesaid two signal with different potential will be amplified respectively through said two amplifiers before being coupled to the bases of $Q_{X+}$ and $Q_{X-}$ to control the conduction state of the transistors so as to determine the output distribution ratio of the string-percussing signal. After being proportionally distributed the string-percussing servo-signal may still, through the two output terminals of $X_+$ and $X_-$ be coupled to the string-percussing signal transmission and processing circuit (4) so as to be transmitted to the various terminal pianos to control the displacement of the combined forte point. FIG. 41 is a system block diagram which includes two terminal pianos or two groups of terminal pianos arranged abreast, and the aforesaid forte point control means, and the distribution circuit of string-percussing strength (46).

Figure 42:
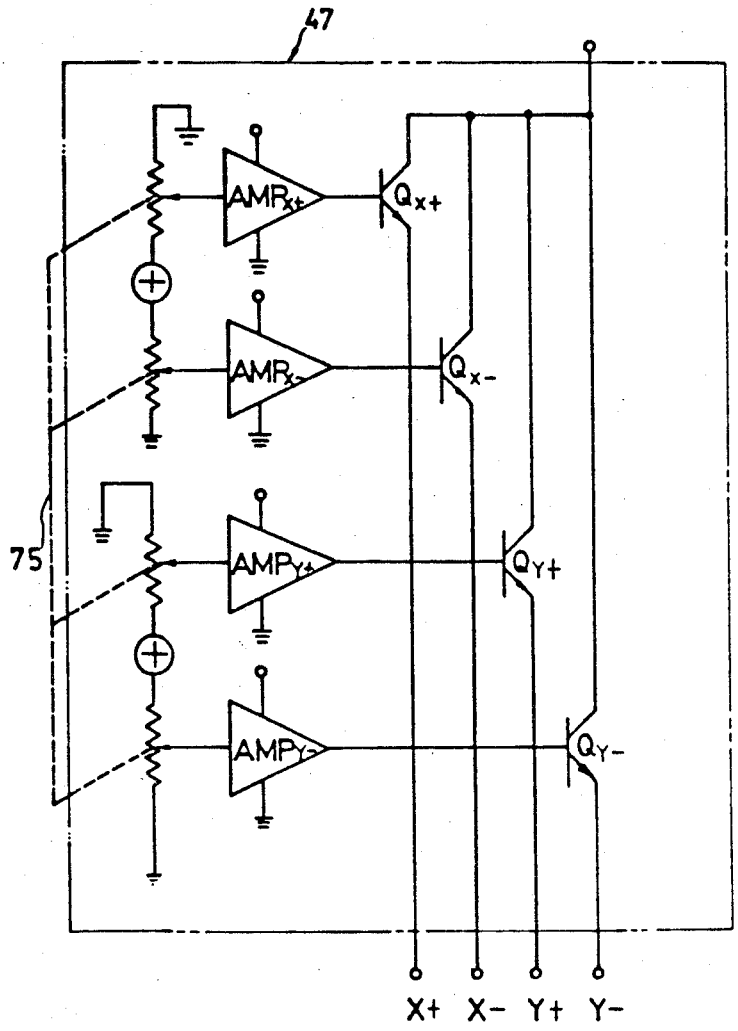
FIG. 42 is a distribution circuit of string-percussing strength to control the combined forte point to vary within a two-dimensional space.

FIG. 42 is a distribution circuit of string-percussing strength to control the combined forte point to vary within a two-dimensional space.

Figure 43:
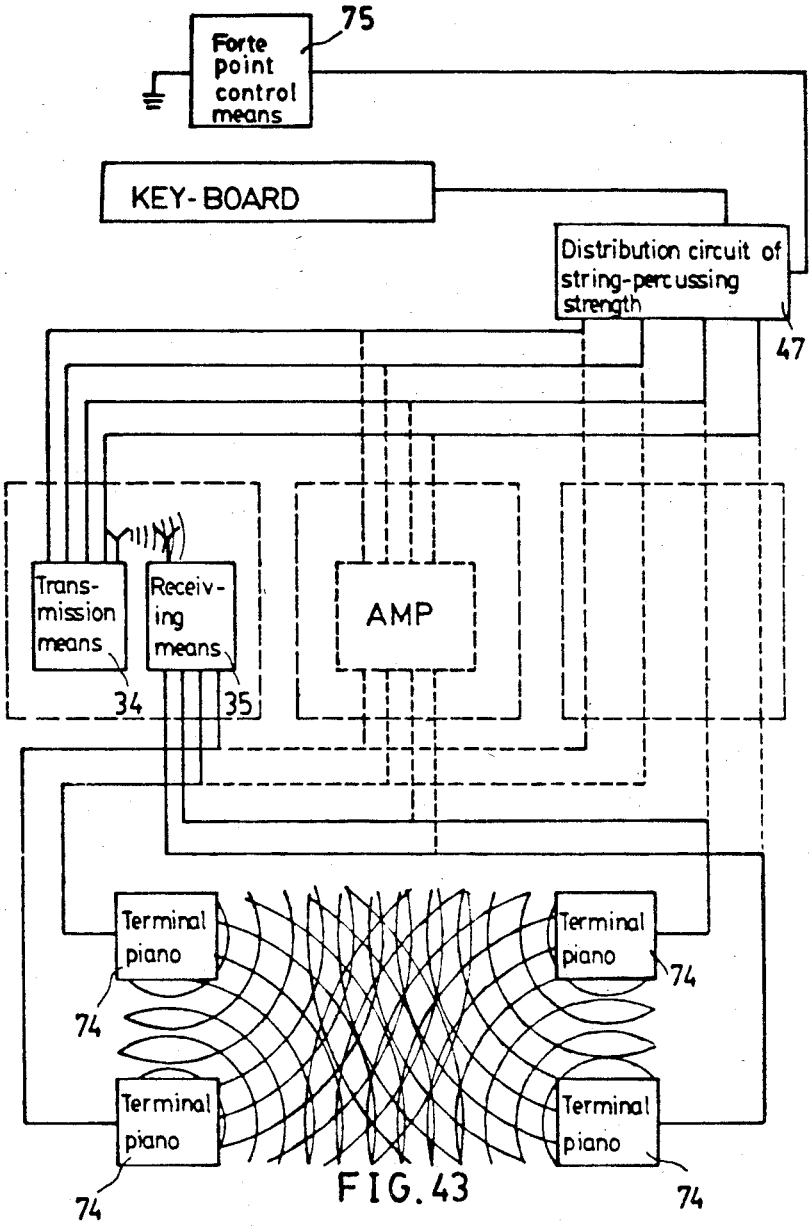
FIG. 43 is a system block diagram including the circuit shown in FIG. 42.
Figure 44:
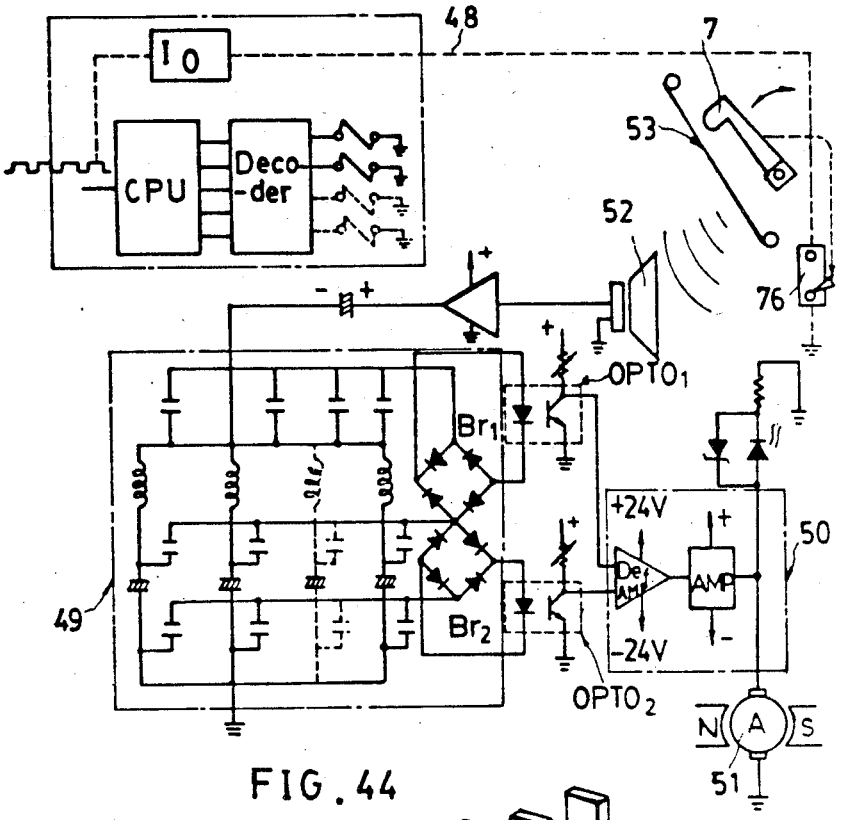
FIG. 44 is the circuit of the automatic string-tuning means in the present invention.

FIG. 43 is a system block diagram including said distribution circuit of string-percussing strength (47).

As to the distribution circuit of string-percussing strength for controlling the combined forte point displacement in a three-dimensional space, it may be developed by analog as mentioned above.

Referring again to FIG. 1, there is shown a monitor (2) for sensing the key speed and the force applied to the key, and said monitor is installed beside the primary rendition piano so as to provide the beginner or pianist with reference. The display of said monitor may be of an analog type or a digital type. In using an analog type, the analog or digital output signal generated by the string-percussing generator will directly, or through a D/A converter be coupled into a memory oscilloscope, which will display the corresponding waveform of the player's finerging skill for reference. In using a digital type, the display means will have the aforesaid data displayed in digits.

Having been mentioned above, the string-percussing servo-driving means (6) in said system can drive the string-percussing hammer driving means (27) in the terminal piano (74) by using an equivalent analog signal or a series of digital signal corresponding to the volume, the speed and the tonality of the output signal of the key-board (1) (or discrete key-board) in the primary rendition piano. The string percussing force and speed in the primary rendition piano can all be divided specifically before being transmitted into the terminal piano as a servo-instruction; therefore, the terminal piano in the present invention can not only operate upon receiving the servo-instruction transmitted from the primary rendition piano, but also can operate upon receiving the digital instruction from other device, such as recording and playback tape, or computer, etc.

As shown in FIG. 1, the primary rendition piano or the terminal piano in the system may also be installed with a register means (8) which may be a recorder tape, a magnetic disk, ROM, RAM, EPROM, an optical, a magnetic or a mechanical type of memory means; the registered signal may be transmitted into a terminal piano having the said same operational function for retransmitting an instruction to drive the string-percussing hammer so as to obtain a completely same rendition result as that of the primary rendition piano. It is particularly good for fidelity when using recorder tape as the register means and using more than two reading/-playback heads for the four track or eight track recording and playback. The system not only can provide remote control rendition but also can register the primary rendition contents for simultaneous or later regenerating rendition at different place and occasion with the original rendition results.

Further, the primary rendition piano and the terminal piano may be provided with an automatic string-timing means, which comprises a key-number identification circuit of string tuning (48) (as a monitor), a "LC" resonant circuit assembly (49) to be driven with micro-sound and being used for selecting the assembly number, a differential amplification and driving circuit (50) and a forward/reverse rotation driving motor assembly for tuning (in the Fig., only showing a motor (5') for tuning a given string.) The tuning theory and the runing operation are described as follows:

In tuning a given string (53) push manually the key corresponding to the string, and the string-percussing hammer (7) coupled to said string will actuate a switch (76) which will have an external pulse signal representing said string coupled to the key-number identification circuit of string tuning (48) which may be made of a micro-computer or other appropriate logic circuit. The identification signal is coupled to the key-number-identification circuit of string tuning (48) through a sensing means (shown in FIG. 3(O) installed in the key to be tuned. Upon receiving said signal, the identification circuit (48) will generate a corresponding signal to turn on the corresponding "LC" resonant circuit so as to be driven by the string-percussing audio frequency signal of said string (53) through the microphone (52). The values of "LC" and "C" in said resonant circuit should satisfy the resonant requirement under the standard frequency of string, and at the correct resonant frequency the reactane $X_L=X_c$, i.e. $V_{XL}=V_{XC}$. Now, the output of said resonant circuit will pass through the two bridge rectifiers $B_{r1}$ and $B_{r2}$ and two optoisolators, $OPTO_1$ and $OPTO_2$ respectively, and then will be coupled to the differential amplification and driving circuit (50) with an equal signal level; consequently, the string-tuning motor (51) will not operate.

In case of the signal of said string (53) tuned being coupled through said microphone (52) being low or too high, variation between the $X_C$ and $X_L$ will take place, and the output of the differential amplicication and driving circuit (50) will change to cause a given string-tuning motor (51) (such as an A.C. or D.C. motor, or a small stepper motor) to operate in order to drive a speed-reducing element to adjust the tension of the steel string until obtaining a correct tune. Further, between the axle end of said motor (51) and the transmission element, a brake means driven with an electro-magnetic means may be installed so as to the stability of the system. In the event of not obtaining the correct frequency after the first tuning, continue to play the key related to the key being tuned so as to couple the string-tuning signal of said string continuously until obtaining a correct frequency and the pilot light LED going out. The aforesaid string-tuning operation may also be done during the rendition by means of the string-percussing signal of the primary rendigion piano or the terminal piano directly coupled to the key-number-identification circuit of string tuning for directly and automatically tuning.

Figure 45:
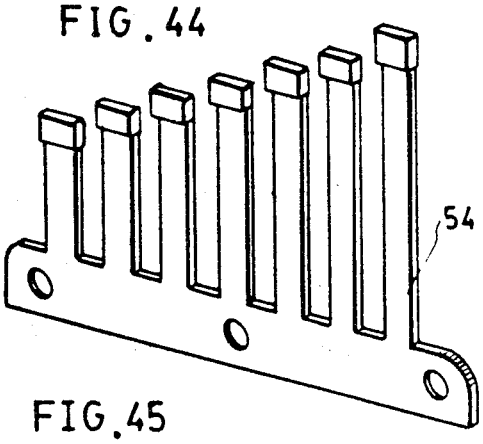
FIG. 45 shows a resonant leaf spring assembly tightly attached to the piano resonant chamber so as to test the vibrating frequency of the string for either manual or automatic string tuning.

In addition to the built-in type, said string-tuning means may be a discrete and automatic type as shown in FIG. 45, in which a resonant leaf-spring assembly (54) is firmly attached to a resonant chamber as a tuning plate to test the vibrating frequency of every string; then, use a manual method or the said string-tuning means to control the string-tuning motor (510 to drive a runing sleeve for tuning. At the end of each said resonant leaf spring assembly (54) a resonance-intensifying metal strip may be installed. Each of said resonant leaf springs can generate a frequency same as that of scales of the piano so as to generate mechanical resonance with the various scales for manual tuning reference.

The aforesaid tuning plate may be coupled with a photocell or an electro-magnetic sensing means so as to sense the amplitude of resonant tuning plate during percussing the string. The sensing signal may be in proportion to the resonant amplitude of said leaf spring.

In the transmission signals of this remote control rendition system, a string-calibration-instruction code may be included, and is to be transmitted to the terminal piano for calibration of the scales by means of said automatic string-tuning means to drive the string-tuning motor (51).

Figure 46:
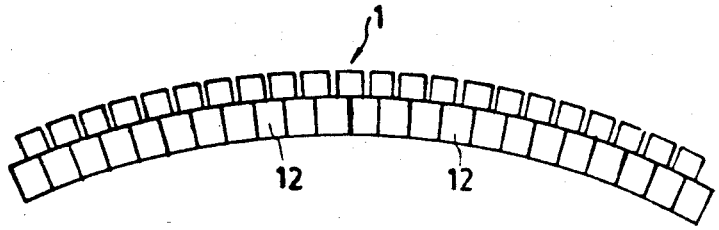
FIGS. 46 to 48 show three different embodiments of the configuration of piano keys.
Figure 47:
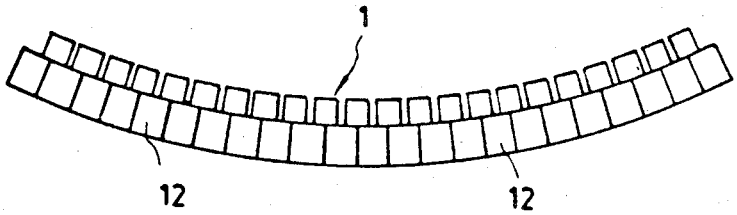
Figure 48:
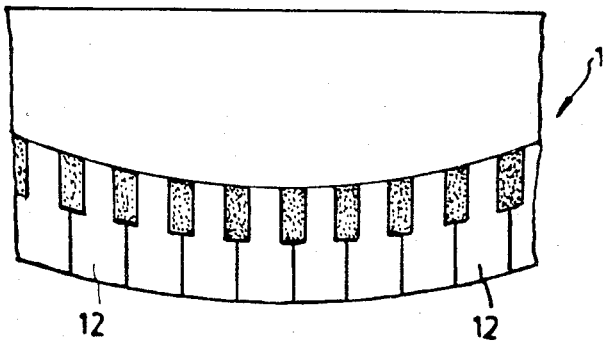

The arrangement of the key-board (1) in the present invention may be designed into the spaes as shown in FIGS. 46, 47 and 48; in FIGS. 46 and 47 (front view), the arrangement shapes of the keys (12) are designed in accordance with the requirements of human engineering, or are designed into an upward convex or downward concave in accordance with the players conditions.

FIG. 48 (a top view) shows the key-board being in a convex shape by using the piano body as a centre.

Referring to FIG. 49, there is shown the keys (12) of piano being arranged in a matrix shape, in which the chromatic scales remain at the original position. In the matrix arrangement, the keys may be arranged in separate rows in accordance with the scale or the "key signature" so as to facilitate the beginner doing practice. Since the matrix shaped key-board has wider cross section, the percussing scope is extended horizontally. Further, said key-board may be designed into a slightly slanting position towards the players face, or into a slightly convex or concave surface so as to facilitate the player moving fingers quickly and accurately to the key in horizontal direction.

The keys to be used in this system may be designed into a convex shape over the often-touched portion as shown in FIG. 50 so as to facilitate the players finger slipping over the keys; the keys may also be designed into a concave shape as shown in FIG. 51 so as to facilitate the players finger slipping over the keys with better accuracy.

In the said resonant chamber, one or more than one set of constant temperature and humidity means as shown in FIG. 52 may be installed. The said constant temperature and humidity means includes an electric heater having temperature setting means so as to control the humidity and an electric fan to circulate the air in the resonant chamber. Said means may also be used in general piano.

I claim:

1. A system for producing multi-dimensional sound comprising:

a keyboard including plural selectively-depressable keys $K_1$–$K_n$;

sensing means, operatively coupled to said plural keys $K_1$–$K_n$, for producing plural signals $S_1$–$S_n$ indicating parameters of the movements of said plural keys $K_1$–$K_n$, respectively;

multiplexing means for multiplexing said plural signals $S_1$–$S_n$ together to produce a multiplexed signal X;

signal distributing means for producing plural replica signals $X_1$–$X_m$ of said multiplexed signal X and for selectively adjusting the relative gains of said replica multiplexed signals $X_1$–$X_m$ independently to produce gain-adjusted replica multiplexed signals $Y_1$–$Y_m$;

demultiplexing means, connected to receive said gain-adjusted replica multiplexed signals $Y_1$–$Y_m$, for independently demultiplexing each of said gain-adjusted signals $Y_1$–$Y_m$ to recover plural sets $A_{1-1}$–$A_{1n}$, . . . , $A_{mn}$–$A_{mn}$ of signals, respectively, said signals $A_{11}$–$A_{m1}$, . . . $A_{1n}$–$A_{mn}$ corresponding to said plural signals $S_1$–$S_n$, respectively, as gain-adjusted by said signal distributing means;

first through mth independent discrete remote pianos including sets $Z_{11}$–$Z_{1n}$, . . . , $Z_{m1}$–$Z_{mn}$ of strings, respectively, selectively moveable hammer means $H_{11}$–$H_{1n}$, . . . , $H_{m1}$–$H_{mn}$, for selectively independently striking said plural strings $Z_{11}$–$Z_{1n}$, . . . , $Z_{m1}$–$Z_{mn}$, respectively, and further including hammer driving means $HD_{11}$–$HD_{1n}$, . . . , $HD_{m1}$–$HD_{mn}$, respectively, operatively coupled to said hammer means $H_{11}$–$H_{1n}$, . . . $H_{m1}$–$H_{mn}$, respectively, for selectively independently mechanically driving said hammer means in response to electrical signals applied thereto; and means for applying said plural sets $A_{11}$–$A_{1n}$, . . . , $A_{m1}$–$A_{mn}$ demultiplexed signals to corresponding hammer driving means $HD_{11}$–$HD_{1n}$, . . . , $HD_{m1}$–$HD_{mn}$, respectively, said hammer driving means $HD_{11}$–$HD_{m1}$, . . . , $HD_{1n}$–$HD_{mn}$ driving said hammer means $H_{11}$–$H_{m1}$, . . . , $H_{1n}$–$H_{mn}$, respectively, in response to parameters of movement of the plural keys $K_1$–$K_n$, respectively, and in response to the relative gains of said gain-adjusted multiplexed signals $Y_1$–$Y_m$.

2. A system as in claim 1 wherein:

at least two of said plural remote pianos are disposed in different x-planes of a predetermined x-y-z cartesian coordinate system;

at least two of said plural remote pianos are disposed in different y-planes of said coordinate system; and at least two of said plural remote pianos are disposed in different z-planes of said coordinate system.

3. A system as in claim 1 further including:

means for storing a representation of said multiplexed signal X over time; and means for reproducing said multiplexed signal X from said representation stored by said storing means sometime after said storing means stores said representation.

4. A system as in claim 1 wherein:

said system further includes means for communicating said gain-adjusted signals $Y_1$–$Y_m$ to a location remote to the location of said keyboard, said plural remote pianos 1 through m located at said remote location; and said demultiplexing means demultiplexes said signals $Y_1$–$Y_m$ communicated by said communicating means.

5. A system as in claim 4 wherein said communicating means includes:

means for modulating a carrier signal with said gain-adjusted signals $Y_1$–$Y_m$;

means for transmitting said modulated signal to a remote location;

means for receiving said modulated signal at said remote location; and means for demodulating said modulated signal to recover said gain-adjusted signals $Y_1$–$Y_m$.

6. A system as in claim 5 wherein said modulating means comprises a pulse-code modulator.

7. A system as in claim 5 wherein said modulating means comprises a frequency modulator.

8. A system as in claim 1 wherein said signal distributing means comprises:

plural transistors $Q_1$–$Q_m$ each including a collector, an emitter, and a control terminal, the collectors of said transistors $Q_1$–$Q_m$ all connected together to receive said multiplexed signal X;

means for producing independently adjustable plural voltage levels $V_1$–$V_m$; and plural respective amplifying means $AMP_1$–$AMP_m$, connected to receive at inputs thereof said plural voltage levels $V_1$–$V_m$, respectively, each for producing an output signal in response to the voltage level applied to the input thereof, said amplifying means $AMP_1$–$AMP_m$ applying said plural output signals to the control terminals of said plural transistors $Q_1$–$Q_m$, respectively, thereby independently controlling the gains of said plural transistors, said gain-adjusted multiplexed signals $Y_1$–$Y_m$ being obtained from the emitters of said transistors $Q_1$–$Q_m$, respectively.

9. A method of producing multi-dimensional sound comprising the steps of:

(1) selectively depressing at least one of plural keys $K_1$–$K_n$ of a keyboard;

(2) producing plural signals $S_1$–$S_n$ indicating parameters of the movements of said plural keys $K_1$–$K_n$, respectively;

(3) multiplexing said plural signals $S_1$–$S_n$ together to produce a multiplexed signal X;

(4) producing plural replica signals $X_1$–$X_m$ of said multiplexed signal X;

(5) selectively adjusting the relative gains of said replica multiplexed signals $X_1$–$X_m$ independently to produce gain-adjusted replica multiplexed signals $Y_1$–$Y_m$;

(6) demultiplexing each of said gain-adjusted signals $Y_1$–$Y_m$ independently to recover plural sets $A_{11}$–$A_{1n}$, . . . , $A_{m1}$–$A_{mn}$ of signals, respectively, said signals $A_{11}$–$A_{m1}$ . . . , $A_{1n}$–$A_{mn}$ corresponding to said plural signals $S_1$–$S_n$, respectively, as gain-adjusted by said gain-adjusting step (5);

(7) applying said plural sets $A_{11}$–$A_{1n}$, . . . , $A_{m1}$–$A_{mn}$ demultiplexed signals to corresponding plural hammer driving means $HD_{11}$–$HD_{1n}$, . . . , $HD_{m1}$–$HD_{mn}$, respectively, operatively coupled to plural selectively moveable hammers $H_{11}$–$H_{1n}$, . . . , $H_{m1}$–$H_{mn}$, respectively, of first through m independent discrete remote pianos, respectively; and simultaneously selectively striking strings of plural sets $Z_{11}$–$Z_{1n}$, . . . , $Z_{m1}$–$Z_{mn}$ of strings disposed in said first through mth remote pianos, respectively, with said hammers $H_{11}$–$H_{1n}$, . . . , $H_{m1}$–$H_{mn}$, respectively, in response to said signals applied to said hammer driving means $HD_{11}$–$HD_{1n}$, . . . , $HD_{m1}$–$HD_{mn}$, respectively, including the step of moving said hammers $H_{11}$–$H_{m1}$, . . . , $H_{1n}$–$H_{mn}$, in response to parameters of movement of said plural keys $K_1$–$K_n$, respectively, and in response to the relative means of said gain-adjusted multiplexed signals $Y_1$–$Y_m$.

10. A method as in claim 9 further including the steps of:

disposing at least two of said plural remote pianos in different x-planes of a predetermined x-y-z cartesian coordinate system;

disposing at least two of said plural remote pianos in different y-planes of said coordinate system; and disposing at least two of said plural remote pianos in different z-planes of said coordinate system.

11. A method as in claim 9 further including the intermediate steps, performed subsequently to said multiplexing step (3) and prior to said producing step (4), of:

(a) storing a representation of said multiplexed signal X over time; and (b) reproducing said multiplexed signal X from said representation stored by said storing step (a) sometime after said storing step (a) is performed.

12. A method as in claim 9 wherein:

said method further includes the step, performed subsequently to said adjusting step (5) and prior to said demultiplexing step (6), of communicating said gain-adjusted signals $Y_1$–$Y_m$ to a location remote to the location of said keyboard; and said demultiplexing step (6) demultiplexes said signals $Y_1$–$Y_m$ communicated by said communicating step.

13. A method as in claim 12 wherein said communicating step includes the steps of:

modulating a carrier signal with said gain-adjusted signals $Y_1$–$Y_m$;

transmitting said modulated signal to a remote location;

receiving said modulated signal at said remote location; and demodulating said modulated signal to recover said gain-adjusted signals $Y_1$–$Y_m$.

14. A method as in claim 13 wherein said modulating step comprises the step of pulse-code modulating said carrier with said gain-adjusted signals $Y_1$–$Y_m$.

15. A method as in claim 13 wherein said modulating step comprises the step of frequency-modulating said carrier with said gain-adjusted signals $Y_1$–$Y_m$.

16. A method as in claim 9 wherein:

said producing step (4) includes the steps of:

applying said multiplexed signal X to the commonly-connected collectors of plural transistors $Q_1$–$Q_m$, and obtaining said gain-adjusted multiplexed signals $Y_1$–$Y_m$ from the emitters of said transistors $Q_1$–$Q_m$, respectively; and said gain-adjusting step (5) includes the steps of:

producing independently-adjustable plural voltage levels $V_1$–$V_m$;

applying said plural voltage levels $V_1$–$V_m$ to the inputs of plural respective amplifying means $AMP_1$–$AMP_m$, respectively, producing, at outputs of each of said amplifying means $AMP_1$–$AMP_m$, and output signal having a level proportional to the voltage level applied to the input thereof, and applying the output signals produced by said plural amplifying means $AMP_1$–$AMP_m$ to the control terminals of said plural transistors $Q_1$–$Q_m$, respectively, thereby independently controlling the gains of said plural transistors in response to said output signals.

* * * * *